United States Patent [19]

Payne

[11] 3,985,144

[45] Oct. 12, 1976

[54] APPARATUS FOR FORMING CIGARETTE FILTERS

[76] Inventor: Leslie E. Payne, 3423 Luther St., Winston-Salem, N.C. 27107

[22] Filed: June 5, 1975

[21] Appl. No.: 584,232

Related U.S. Application Data

[62] Division of Ser. No. 434,747, Jan. 18, 1974, Pat. No. 3,958,498.

[52] U.S. Cl. ..... 131/92; 131/29; 131/254

[51] Int. Cl.[2] ..... A24C 5/50

[58] Field of Search ..... 131/92, 11, 94, 68, 131/88, 29, 61 A, 66 R, 76, 27 A, 20 R, 253–255; 93/1 C, 77 FT

[56] References Cited

UNITED STATES PATENTS

| | | | |
|---|---|---|---|
| 2,075,055 | 3/1937 | Prager | 131/20 R |
| 2,250,452 | 7/1941 | Alm | 131/255 |
| 2,506,016 | 4/1970 | Smith | 131/92 |
| 2,918,922 | 12/1959 | Eissmann | 131/94 X |
| 3,199,515 | 8/1965 | Lowe et al. | 131/88 X |
| 3,205,899 | 9/1965 | Ackermann | 131/254 X |
| 3,779,849 | 12/1973 | Beard et al. | 93/1 C |
| 3,791,265 | 2/1974 | Westcott et al. | 93/1 C |

*Primary Examiner*—John F. Pitrelli
*Attorney, Agent, or Firm*—Grover M. Myers; Manford R. Haxton

[57] ABSTRACT

This invention relates to an apparatus for forming cigarette filters, including a drum for receiving and holding a plurality of filters and a heated probe which can be moved into contact with the filters to form the filters into a desired configuration.

4 Claims, 27 Drawing Figures

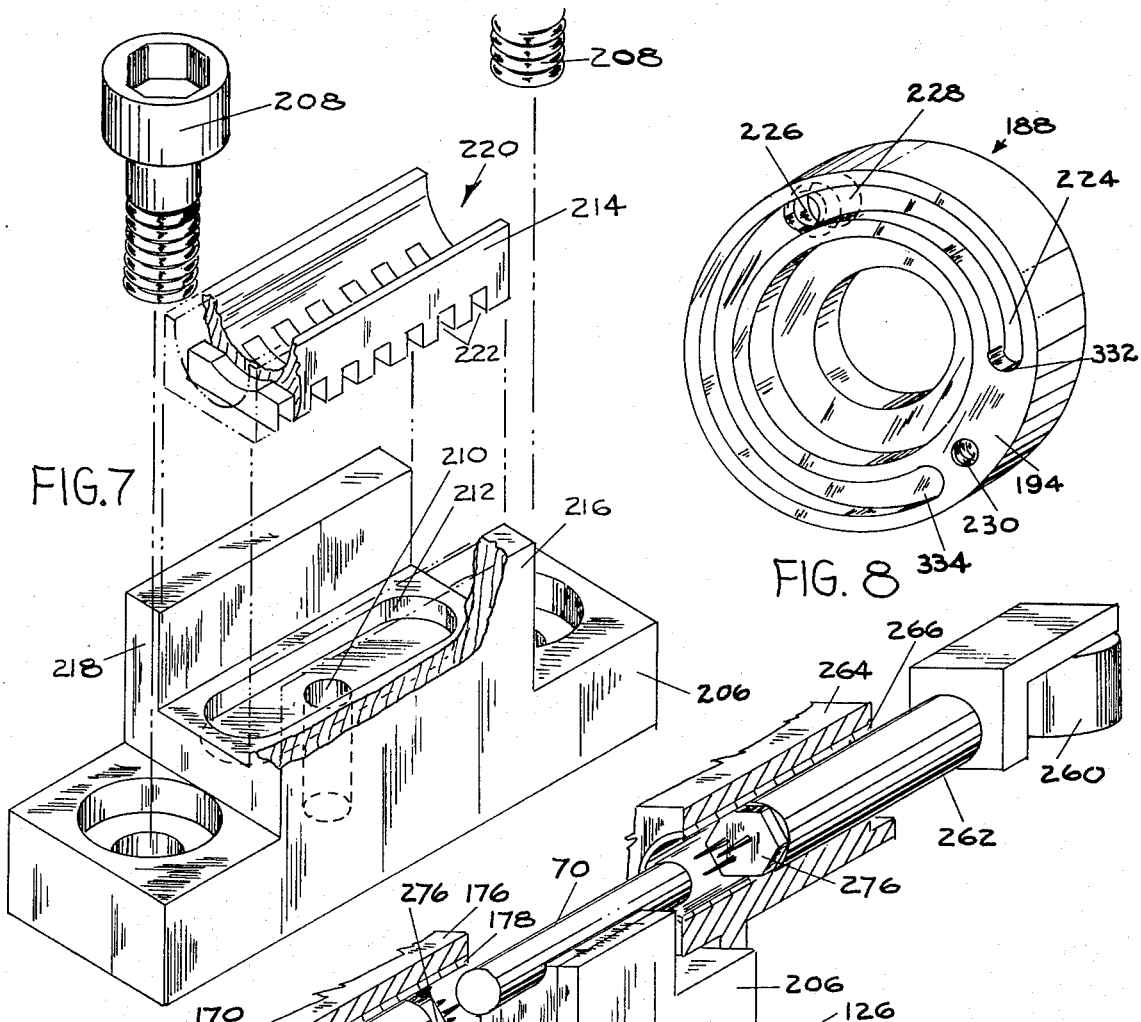
FIG.7
FIG. 8
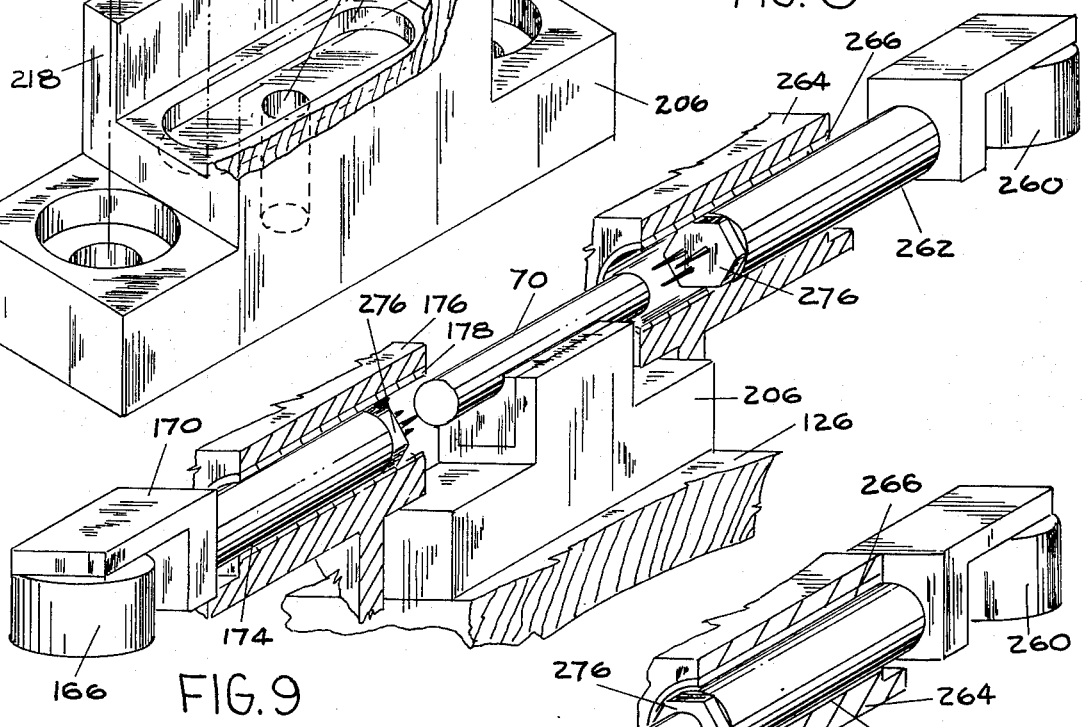
FIG. 9
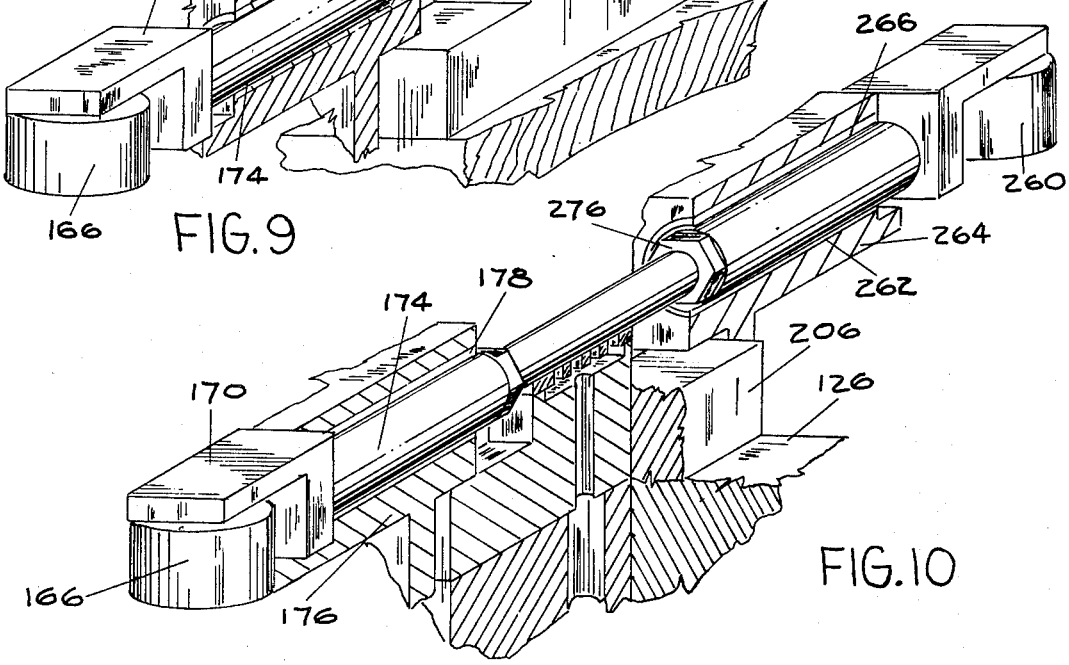
FIG.10

APPARATUS FOR FORMING CIGARETTE FILTERS

This is a division of application Ser. No. 434,747, filed Jan. 18, 1974, now U.S. Pat. No. 3,958,498.

BACKGROUND OF THE INVENTION

This invention relates to a method and apparatus for forming unique cigarette filters and combining the filters with a tobacco rod to form filter cigatettes.

Most of the presently known cigarette filters are generally formed from a continuous tow of cellulose acetate fibers into a long continuous rod. The continuous rod is then cut into appropriate lengths for processing which are called 4-ups and 6-ups in the industry. A 4-up is 4 single filters or 2 dual (2-up) filters while a 6-up is 6 single filters or 3 dual filters in length. The 4-up and 6-up filters are transported from the filter-making machine either manually or by an automatic conveying system to the hopper or a cigarette assembler machine.

The cigarette assembler takes the 4-up or 6-up filters and slits them into dual filter (2-up) lengths and attaches them to a tobacco rod being supplied to the assembler by a cigarette maker. A tobacco rod is attached to each end of the dual filter in the cigarette assembler to form a double cigarette unit. The double cigarette is then separated into two single cigarette units by slitting it at the center of the dual filter. The cigarettes are passed through various inspection systems before being transported either manually or automatically to a packer unit.

There are various types of filter configurations and materials used in the manufacture of filter cigarettes; however, in all instances, the filter is made on one machine in a continuous rod and then slit into 4-ups or 6-ups for use in a cigarette assembler which joins the filter to the tobacco rod.

In recent years, there have been many attempts to produce cigarette filters with better filtering efficiency and this filter research has produced many filters of varying configurations. Some are made completely of cellulose acetate while others are made of a combination of materials such as extruded plastics cores, activated charcoals, a combination of plastic tubes and cellulose acetate, etc. Generally the cellulose acetate filters are made into a continuous rod or tube and various operations are performed on the external surface of the rods to produce filters of different configurations. Some examples of such filters are disclosed in the following U.S. Pat. Nos: 3,752,166; 3,599,646; 3,690,326 and 3,648,711.

Most of these types of filters disclosed in the patents mentioned above utilize a high-surface area/high density theory of filtration as well as a cross fiber method of filtration. In other words, the smoke is exposed to a large surface area so the smoke velocity will be decreased, then the smoke is drawn through a denser filter medium than is used in a standard filter in a direction which is cross-wise to the direction fibers in the filter plug. Due to the more dense filter medium and the cross fiber path the smoke follows, there is more likelihood that the particulate matter entrained in the slowly traveling smoke will come in contact with a fiber and be removed from the smoke being inhaled.

Some examples of the extruded plastic filters are shown in the following U.S. Pat. No. 3,577,995; 3,577,996; 3,612,064 and 3,628,540. The filters disclosed in the above-mentioned patents are generally made of an extruded plastic body having a series of restrictive passages through which the smoke is directed. These restrictive passages cause an increase in the smoke velocity when the cigarette is inhaled. Baffles are located within the passages so that the smoke will impinge against them as it is drawn through the filter. This type of filter used the impingement principle to produce a high efficiency filtration. The impingement technique results from the impaction of smoke on the baffles which causes particulate matter in the smoke to adhere to the baffles. As a residue builds up on the baffles, particulate matter entrained in the subsequently inhaled smoke impinges upon the baffle containing the residue and adheres more easily to this residued particulate matter thereby being removed from the smoke.

Each of the above-mentioned filter configurations produces problems in the various manufacture operations to form the cigarette as well as increasing the cost of production. The cost of forming the high density cellulose acetate fibers is extremely high because the filter requires much more cellulose acetate material to produce the high efficiency filtration results. With cost of the filter unit itself being extremely high, this also will raise the cost of producing a filter cigarette unit. Furthermore, many of the configurations of filters formed with cellulose acetate have irregular peripheral surfaces, these irregular surfaces cause problems when trying to attach the tobacco rod to the filter which detracts from the quality of the cigarette as can be understood. This increases the cost of a cigarette unit because the quality control equipment has to be increased. Filters made from extruded plastic bodies produce many of the same difficulties as mentioned above. Especially, in the area of joining the filter to the tobacco rod.

A filter which will overcome the above-mentioned problems has been developed and an application has been filed on this unique filter. This related application is assigned to the assignee of this application and is entitled, "Filter Element for Cigarettes" which was filed on July 9, 1973, and assigned U.S. Ser. No. 377,858. This new and improved filter uses both the impingement and cross-fiber filtration principle for high efficiency filtration and is made solely of cellulose acetate.

The above-identified new filter reduces the density required by the high surface/high density filter while retaining the same efficiency. It also has a cylindrical body with a uniform peripheral surface which lends itself to better handling and joining with a tobacco rod. This filter configuration generally includes at least one bore extending through each end of the standard cellulose acetate filter plug, each bore terminating prior to the end of the plug. Generally the bores are parallel to the axis of the plug but are not aligned. The smoke is drawn into the bore and its velocity is increased because of the restrictive sizes of the bores. The smoke velocity being increased will produce an impinging effect when the smoke strikes the bottom of the bore, causing particulate matter to concentrate at the bottom of the bore. The particulate matter in subsequent inhalations of smoke will travel through the concentrated area and is more likely to contact and coheless with other particulate matter already deposited on the fibers and be removed from the smoke. The smoke passing through the concentrated particulate matter also passes from one bore to the other in a crosswise manner to produce a cross-fiber filtration. It can be seen that both impingement principle as well as a cross-fiber filtration principle are utilized in this new improved filter.

One of the main problems with developing such a filter, however, is to produce a method and apparatus to manufacture such a filter economically. It is believed that such a method and apparatus has been developed and set forth herein.

Summary of the Invention

It is, therefore, an object of this invention to provide a method and apparatus for forming a new and improved cigarette filter and joining it to a tobacco rod.

Another object of this invention is to provide a machine and method for high speed forming of cellulose acetate cigarette filters.

Another object of this invention is to provide a high speed method of forming cellulose acetate filters by inserting heated dies into the cellulose acetate.

Another object of this invention is to provide an apparatus which can be associated with a standard cigarette assembler.

Another object of this invention is to provide an apparatus which will form a cigarette filter having internal or external bores extending into the filter plug from each end.

Another object of this invention is to provide a method of forming external grooves or passages on a cellulose acetate filter plug.

Another object of this invention is to provide a method and apparatus for high speed forming of high performance filters for use in the cigarette industry.

Another object of this invention is to provide forming drums on a cigarette assembler machine which receives filter plugs for passages in each end of the filter plug by using heated probes.

Still another object of this invention is to provide a mechanism for manipulating a plurality of heated probes which can be inserted into the ends of the filter plugs to form internal bores within the plug or external grooves on the peripheral surface of the plug.

Still another object of this invention is to provide a forming drum for cigarette assembler machines which receives individual filter cigarette units and forms at least one internal bore in the mouth end of the filter.

These and other objects are accomplished by the present invention through the use of a first and second forming drum associated with a cigarette assembler which joins filter and tobacco rods to a filter plug. The first forming drum is basically utilized to form the interior end of the filter plug prior to its assembly with the tobacco rod while the second forming drum will form the outer or mouth end of the filter plug after the filter plug and tobacco rods have been joined and slit into single cigarette units.

The first filter drum receives a dual filter which is supplied to the assembler machines through a hopper. A plurality of transfer drums take the single 4 or 6-up filters from the hopper and transfer them onto a slitting drum where they are slit into 2-up or dual filters. The dual filters are aligned and passed to a transfer and acceleration drum associated with the first forming drum which receives the dual filters. The dual filter is placed in one of a series of vacuum seats which are positioned on the periphery of an air drum for the first forming drum assembly. This first air drum is secured to a rotatable shaft which is geared to the movement of the cigarette assembler.

On the opposite sides of the air drum are located a series of cam operated plungers. Each plunger in the series has at least one probe secured to one end which can be inserted into one end of the dual filter carried in the vacuum seat. The plungers are manipulated in a reciprocating motion by a camming mechanism. The camming operation occurs as the air drum is rotated.

Heating elements are provided with each series of plungers to heat the probes to a predetermined temperature. When the heated probes are inserted in the filter body, the cellulose acetate fibers are formed and set and give a particular configuration to the filter body. Upon extraction of the probes, the filters are transferred to an alignment drum which, in turn, deposits the filter on the cigarette drum of a cigarette assembler machine between two cut tobacco rods.

The dual filter is then joined to the tobacco rods on the assembler. The formed ends of the filter being adjacent to the tobacco rod. The dual cigarette is then slit into two single cigarette units. The slit cigarettes pass through a willie-turn drum on the assembler so that the filters will be oriented in the same direction as they leave the assembler machine. These oriented cigarettes are deposited on a catcher chain which transports the cigarettes to the second forming drum.

Transfer drums pick up the cigarettes from the catcher chain and deposit them onto a plurality of seats on a second holding or air drum. The second holding drum is secured to a rotatable shaft which is geared to the motion of the cigarette assembler machine as is the first holding drum.

Cam rings are located on opposite sides of the holding drum. These cam rings are generally cylindrical in shape and have a skewed perpheral groove on their outer surface. A plurality of cam followers are carried in the grooves, each follower having a plunger secured thereto. A plunger holding ring is provided inwardly of the cam rings and serves as a guide for the plungers and to hold the plungers in alignment with the seats on the air drum. One series of the plungers has a vacuum seat at their ends which receives the tobacco end of the filter cigarette and holds it on the seat of the air drum. As each of these vacuum plungers is reciprocated, the filter end of the cigarette is moved into a gland ring which carries an air gland or clamp that will grip the filter end of the cigarette and prevent it from moving.

The second series of plungers carries a probe on their end which is inserted into the mouth end of the cigarette filter. A heating element is provided with the second series of plungers and will heat the plungers and probe so that the cellulose acetate fibers of the filter are formed and set when the probe is inserted in the filter body.

When the probes are extracted from the filter end of the cigarette unit, the filter cigarette passes from the forming drum to a transfer drum which deposits the cigarette on a conveyor for transport to a cigarette packing machine.

BRIEF DESCRIPTION OF THE DRAWINGS

FIG. 7 is a detailed perspective of a vacuum seat used on the forming drum in accordance with the present invention;

FIG. 8 is a detail of an air control ring used in the first forming drum according to the present invention;

FIGS. 9 and 10 are detailed perspectives of the reciprocating plungers according to the present invention, in a retracting and inserting position, respectively;

BRIEF DESCRIPTION OF A PREFERRED EMBODIMENT

Figure 1:
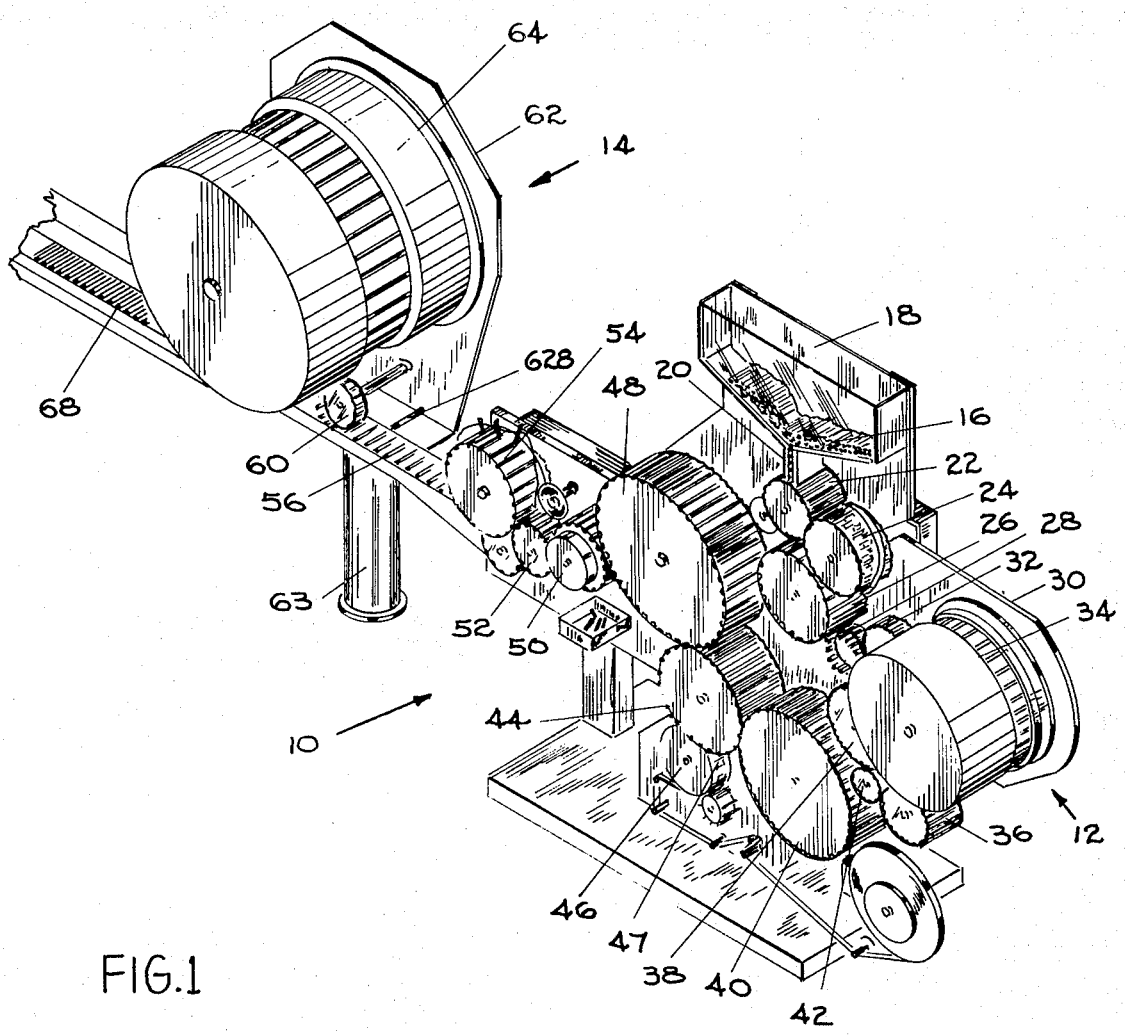
FIG. 1 is a perspective of a filter forming apparatus which is attached to a cigarette assembler machine in accordance with the present invention.
Figure 2:
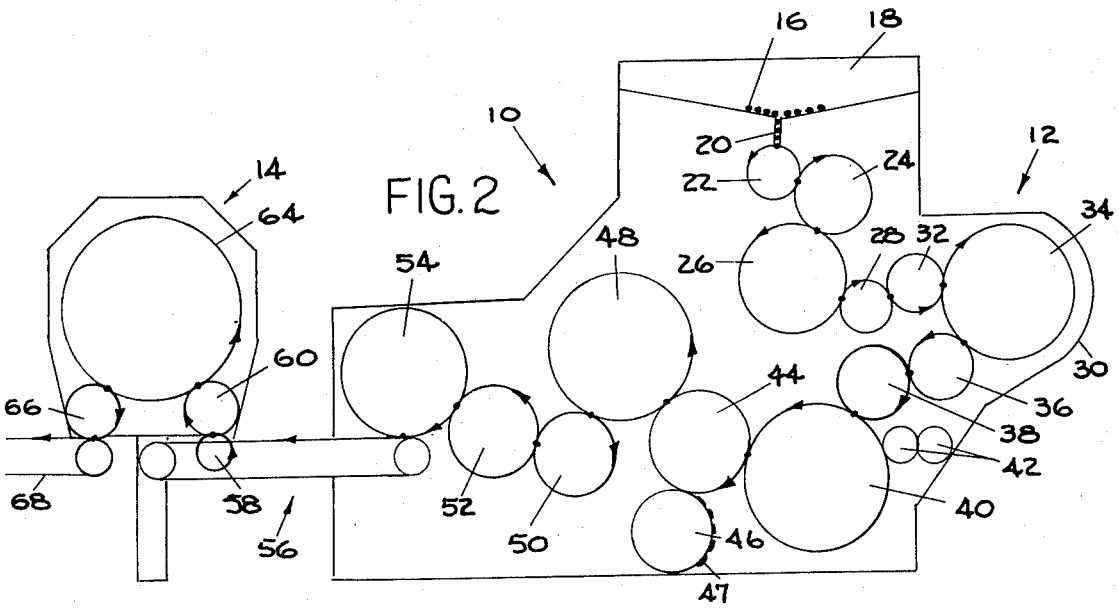
FIG. 2 is a diagrammatic elevation of a cigarette assembler which has been modified by adding two filter forming drums according to the present invention.

Referring more particularly to the drawings in FIGS. 1 and 2, the numeral 10 indicates a filter cigarette assembly machine modified with a dual filter forming unit 12 and a filter cigarette forming unit 14. The cigarette assembly machine joins a dual filter unit to two tobacco rods which are delivered to the assembler from a cigarette maker machine (not shown). This particular assembler illustrated is built by Hauni-Werke Körber & Co., K.C. of Germany.

A supply of 4-ups or 6-up filters 16 are placed in hopper 18 and are fed through inlet channel 20 onto a filter slitting drum 22 which will cut the 4-up or 6-up filters into two or three dual (2-up) filter lengths. Although the present invention can be used on either a 4-up or 6-up assembler, the description hereinafter will refer to the 6-up assembler. It should be understood, however, that the present invention is not limited to use on a 6-up filter assembler.

The dual filters from the slitting drum 22 are transferred onto a grating drum 24 which will take the dual filters and arrange them in stepped alignment. The filters are then transferred from the grating drum 24 to an alignment drum 26 which takes the two outer filters and guides them to a central location on the drum so that the dual filter unit will be transferred from the alignment drum one at a time.

The dual filters pass from the alignment drum 26 to a transfer drum 28. This transfer drum is part of the dual filter forming unit 12 (see FIG. 3) which is mounted on a plate 30 secured to the existing machine. The transfer drum 28 takes the dual filters from the alignment drum 26 and places them on a transfer-acceleration drum 32 which adjusts the angular speed at which the filter units are traveling and transfers it to a dual filter forming drum 34. On the dual filter forming drum 34, a forming operation is performed on the filters as the filters travel with the periphery of the drum. This operation will be described in further detail hereinafter. From the forming drum 34, the filters are passed to a transfer drum 36 (see FIGS. 2 and 3) which, in turn, transfers the filters to a second transfer acceleration drum 38 that deposits the filters on a cigarette drum 40 which is part of the existing Hauni assembler.

Tobacco rods from a cigarette maker (not shown) are received by the assembler 10 at a pair of deflective drums 42 (see FIG. 2) which take the tobacco rods of appropriate lengths and place one on opposite ends of the dual filter on the cigarette drum. The dual filter and the tobacco rods are aligned on the cigarette drum to form a double filter cigarette having a tobacco rod adjacent each end of the dual filter.

The double filter cigarettes are then passed from the cigarette drum to a transfer drum 44 which passes by a tipping drum 46 so that a tipping wrapping 47 is attached to the double filter cigarette unit. From the transfer drum 44, the double filter cigarette units are passed to a wrapping drum 48 where the tipping is wrapped around the filter and tobacco rods joining the units together.

The double filter cigarette then passes onto an inspection drum 50 where the cigarette is leak-tested. From the inspection drum, the double filter cigarette passes onto a second slitting drum 52 where the double cigarette is slit at the center of the dual filter so that two single cigarette units are formed. As can be seen, the single cigarettes will be oriented in opposite directions; therefore, these units pass into a willie-turn drum 54 which orients all the single cigarette units so that their filter ends are in the same direction. For use in the present invention, the willie-turn drum orients the cigarettes so that their filters are towards the mounted end of the drums or to the rear of a catcher chain 56 as shown in FIG. 1.

The cigarette units are transported from the catcher chain 56 to the filter cigarette forming unit 14. A pick-up drum 58 removes the cigarettes from the catcher chain 56 and transfers them to a transfer-acceleration drum 60 mounted on plate 62 which is, in turn, mounted on a vertical support 63. The transfer-acceleration drum 60 deposits the cigarette units on a forming drum 64. On forming drum 64, the cigarette filters are formed into a particular configuration as will be explained hereinafter. The formed filter cigarette units leave the forming drum 64 via transfer drum 66 which deposits the product on a belt conveyor 68 for transportation to the cigarette packing machine.

Figure 3:
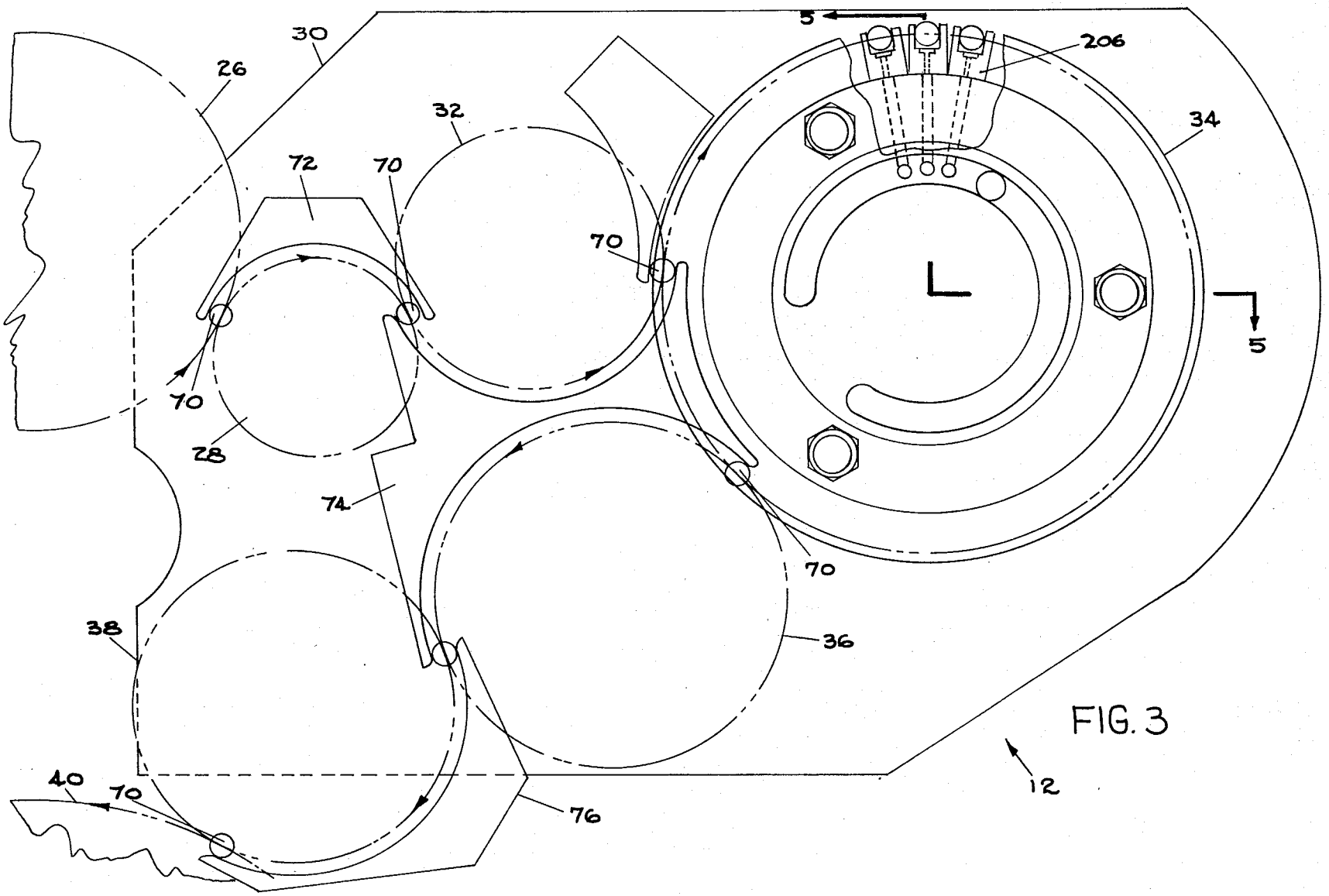
FIG. 3 is a front diagramatic elevation view of a first filter forming unit illustrating the forming drum and its associated transfer and alignment drums.

Turning now to the dual filter forming unit 12, as can be seen in FIG. 3, a dual filter unit 70 is removed from the periphery of the alignment drum 26 by upper guide 72 which holds the filter on the periphery of transfer drum 28 until the upper guide terminates. A center guide 74 removes the dual filter from the periphery of the transfer drum 28 and deposits it on the periphery of transfer acceleration drum 32. The upper surface of the center guide 74 holds the filter on drum 32 until the filter is deposited on forming drum 34.

Upon completion of the forming operation, the dual filters 70 are released from the forming drum 34 and deposited on transfer drum 36 by the lower surface of center guide 74. Guide 74 holds the cigarette on drum 36 until the guide terminates and the filter is engaged by lower guide 76 which holds the filter on transfer acceleration drum 38. When the guide 76 terminates, the dual filter 70 is deposited on cigarette drum 40 of the existing machine.

Figure 4:
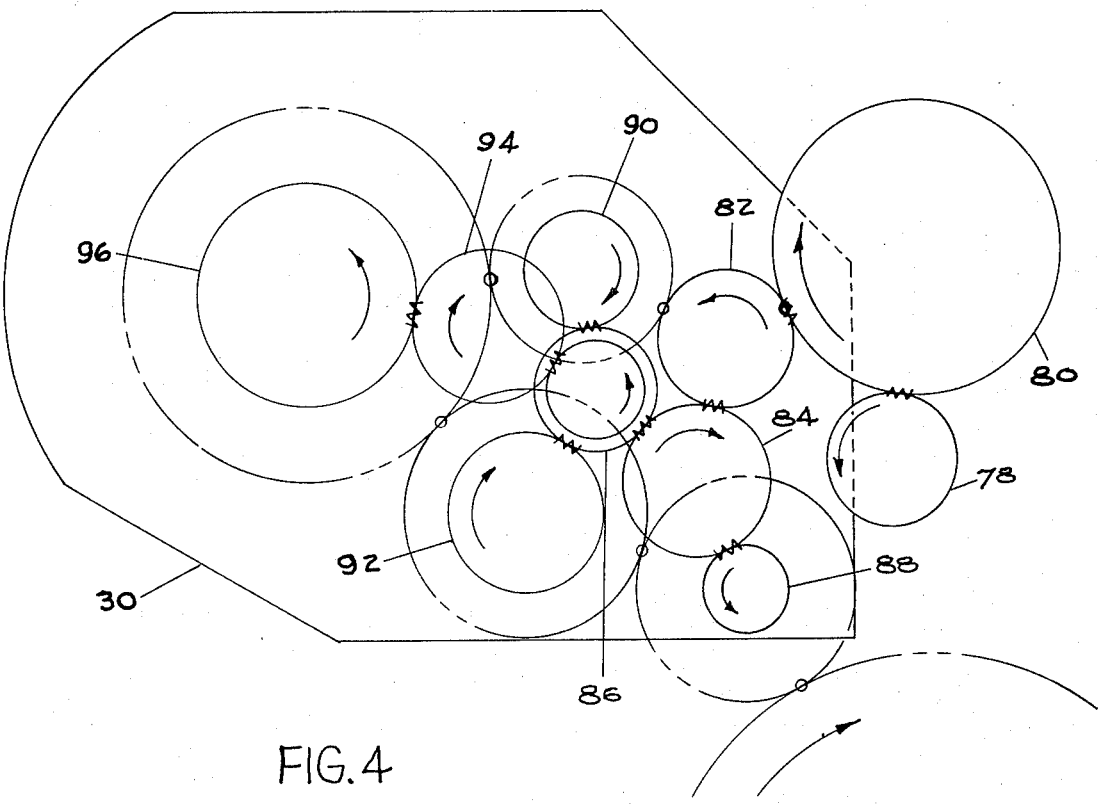
FIG. 4 is a rear diagramatic elevation view of the first filter forming unit illustrating its gear drive mechanism.

Forming drum 34 and its auxiliary drums are driven in the following manner. A clutch drum and a delivery drum were removed from the original machine so that the forming unit 12 could be mounted. A drive gear 78 (see FIG. 4) which is an existing gear used for the clutch drum is used to drive a pitch line gear 80 on the shaft of alignment drum 26. The pitch line gear 80, in turn, drives another pitch line gear 82 on the shaft of transfer drum 28. Gear 82 meshes with and drives an idler gear 84 which is journaled in a suitable manner on mounting plate 30.

The idler gear 84 drives a dual idler gear 86 and a shaft mounted gear 88 mounted on the shaft of transfer-acceleration drum 38. The idler gear 84 contacts the outer gear of the dual gear 86 which, in turn, contacts and drives shaft mounted gears 90 and 92 of transfer-acceleration drum 32 and transfer drum 36, respectively. The inner gear of the dual idler gear 86 drives a second single idler gear 94 which is suitably journaled on the mounting plate 30 and which, in turn, drives the forming drum gear 96 which is mounted on the drum shaft. The size of the various gears, of course, determine the angular speed with which they are driven with respect to one another.

Figure 5:
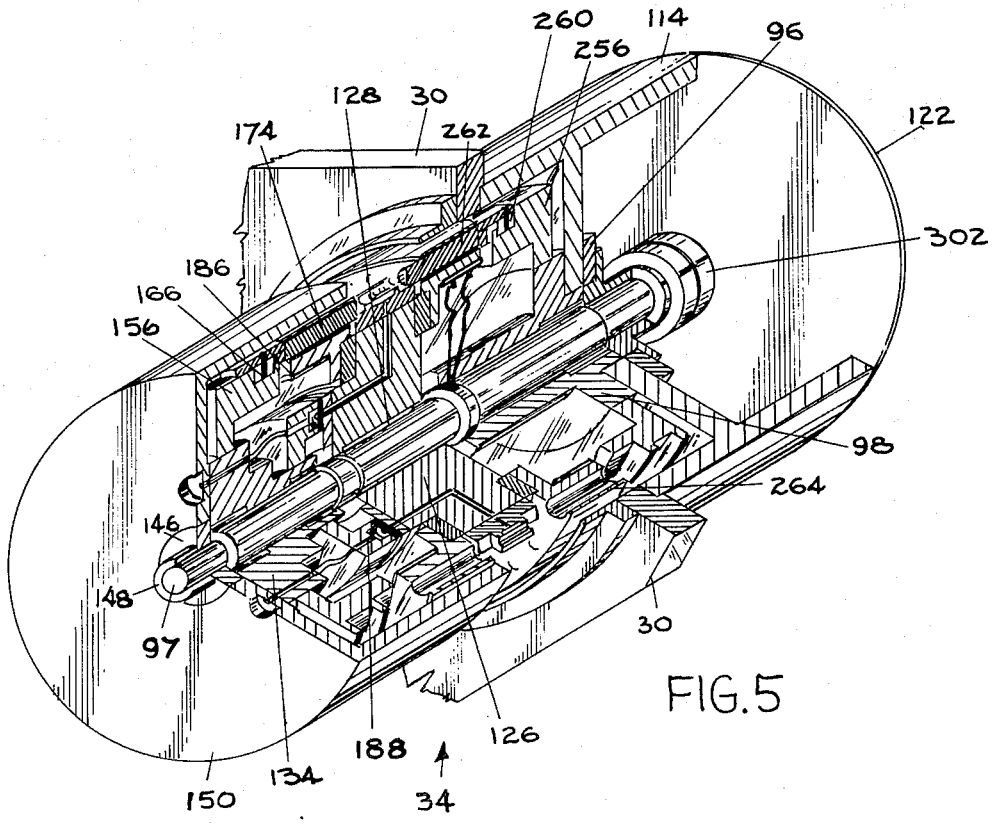
FIG. 5 is a cut-away perspective of the first forming drum according to the present invention.
Figure 6:
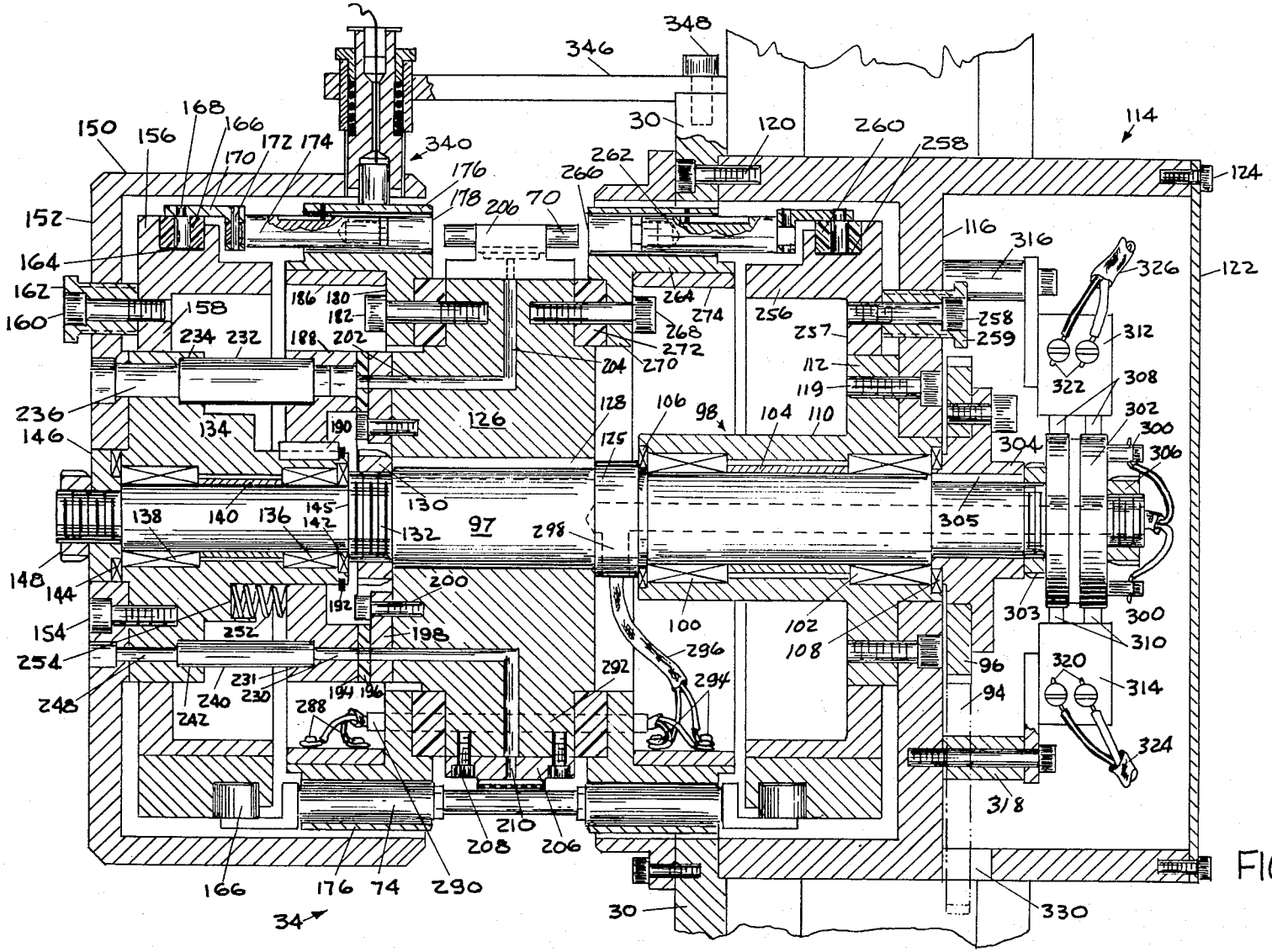
FIG. 6 is a cross-section view taken along line 5—5 of FIG. 3.

In FIGS. 5 and 6, a dual filter forming drum 34 is illustrated. The forming drum has a shaft 97 which is journaled in a bearing housing 98 having a forward and rear radial bearing 100 and 102, resepctively, carried in a recessed portion of the housing located at each end of the housing bore. A spacer 104 is located between the radial bearings and aids in holding the bearings in position. The shaft 97 has a thrust washer 106 which holds the radial bearing 100 within the housing. A thrust bearing 108 is provided in the other end of the housing to hold rear bearing 102 in position. The bearing housing has a cylindrical portion 110 and an outwardly extending radial flange 112 which is located over the rear radial bearing 102. A cylindrical cover member 114 having a radially extending internal flange 116 is secured by a plurality of bolts 119 to the bearing housing flange 112. The forward end of the cover member 114 is secured by a plurality of bolts 120 to the mounting plate 30 which carries the filter forming unit. On the rear end of the cylindrical cover member 114 is a circular cover plate 122 which is secured to the cover member by suitable fasteners 124.

The shaft 97 has an enlarged annular portion 125 at approximately its mid-point which holds the thrust washer 106 in position. Forward of the enlarged portion 125 abutting its forward face is a main air drum 126. The air drum has a solid cylindrical configuration and is keyed to shaft 97 by key 128. The main air drum 126 is held on the shaft by a nut 130 which is threaded onto a threaded portion 132 of shaft 97. A second bearing housing 134 is carried on the outer end of the shaft 97 forward of air drum 126. The housing has a general cylindrical step configuration increasing in size from the inside out. A pair of radial bearings 136 and 138 are positioned within a bore in the housing 134. A spacer 140 is provided between the bearings to aid in holding the radial bearings in position. A pair of thrust bearings or washers 142 and 144, such as a pair of brass rings, hold the radial bearings within the housing. Bearing 142 is also in contact with a shoulder 145 on shaft 97 adjacent the threaded portion 132 of the shaft. A washer 146 holds thrust washer 144 in position, and a nut 148 is threaded onto the threaded end of shaft 97 and contacts washer 146.

A hollow cylindrical cover member 150 having an end plate 152 is secured to the bearing housing 134 by a plurality of bolts 154 extending through the end plate 152 and threaded into the bearing housing 134.

Surrounding the large portion of the bearing housing 134 is a cam ring 156 having an inwardly extending flange 158 which rests on the peripheral surface of bearing housing 134. The cam ring 156 is secured in place by a plurality of bolts 160 which extend through adjusting bolts 162 that are threaded through the end plate 152 of cover member 150. The inner end of the adjusting bolt 162 rests against flange 158 of the cam ring. A cam groove 164 is machined into the outer peripheral surface of cam ring 156. A plurality of cam followers 166 are positioned in the cam groove. The cam followers 166 are generally cylindrical in shape and are made from a suitable insulative material.

A pin 168 extends through the centers of the cam follower and is secured to an L-shaped bracket 170 which extends rearwardly from the cam ring 156 and is secured by a pin 172 to one end of a plunger assembly 174. The plungers 174 extend inwardly through a heated plunger holding ring 176. The heated plunger holding ring has a plurality of bores corresponding to the number of plunger assemblies contiguous to its outer edge. The bores extend through the ring 176 and carry a tubular bearing bushing 178 made of a suitable material such as bronze. The plunger holding ring 176 has an inwardly extending flange 180 which is secured to the main air drum 126 by a plurality of bolts 182 spaced around the forward face of the drum.

An annular spacer ring 184 of a suitable insulating material spaces the plunger holding ring 176 from the main air drum 126. Located forward of the flange 180 and within the plunger holding ring, an annular heating element 186 is connected to a power source as will be explained hereinafter.

The air control ring 188 is keyed to the inside step portion of housing 134 by key 190 and, therefore, will not rotate when shaft 97 is rotated. A retaining ring 192 holds key 190 and air control ring 188 in position. The air control ring 188 is made of hardened steel and its internal face ground and polished at 194 and is in contact with a carbon ring 196 which is secured by any suitable adhesive to a steel ring 198. The steel ring 198 is secured to main air drum 126 by bolts 200. The contacting surface 194 between the air ring 188 and the carbon ring 196 is the mating surface between the non-moveable portion of the left side of the forming drum, as seen in FIGS. 5 and 6, and the moveable air drum 126 which is in the center of the forming drum. The carbon ring 196 and the steel backing ring 198 have a plurality of circumferentially spaced holes extending therethrough which coincide with corresponding bores 202 in main air drum 126 which are parallel to the axis of the drum. These bores extend into the drum and terminate approximately in the mid-point of the drum. At this point, bores 204 extend outwardly from and perpendicualr to the axis of the drum and terminate on the surface of the air drum 126.

Secured around the periphery of the air drum 126 are a plurality of vacuum seats 206 which are detailed in FIG. 7. These vacuum seats are secured to the main drum by fasteners 208. The vacuum seats have a bore 210 extending through their center which terminates in an oval shaped recess 212 in the bottom surface of the vacuum seats. An insert 214 is positioned over the oval recess between two extending walls 216 and 218 which are formed in the seat. The insert has a generally semicircular shaped trough 220 in which the cigarette filter will rest; and, along its bottom, the insert has a plurality of spaced grooves 222 which communicate with the trough 220. This particular design of vacuum seat permits the filter to be more securely held in the seat by providing a greater surface area which a vacuum will affect.

As mentioned previously, the bores 202 within the main air drum 126 extend through the steel ring 198 and carbon ring 196 and communicate with air ring 188. A detail of air ring 188 is shown in FIG. 8. The air ring 188 has a groove 224 in face 194 which contacts carbon ring 196. The groove 224 extends circumferentially but only partially around the face of the ring. Within the groove 224 is a hole or bore 226 which extends through the ring into an enlarged bore 228 which exits on the other side of the air ring. Another bore 230 contiguous to one end of the groove 224 extends through the air ring.

Secured with the enlarged bore 228 in the air ring 188 is a tube 232 (see FIG. 6) which extends into a similarly sized enlarged bore 234 in housing 134. This enlarged bore 234 narrows down to a smaller bore 236 which extends through the housing 134 and through end plate 152 and communicates with a vacuum source not shown.

Bore 230 in air ring 188 also has an enlarged portion 231 which receives a flexible tube 240 which extends from the air ring 188 into an enlarged bore 242 within housing 134. The enlarged bore 242 narrows down to another bore 248 which extends through the housing 134 and into end plate 152 and communicates with a low pressure air source not shown.

In order to maintain the air ring 188 in contact with the carbon ring 196, a spring 252 is provided and is located between the housing 134 and the back surface of air ring 188. This spring contacts the back of air ring 188 and fits into a recess 254 in housing 134.

Turning now to the mechanisms on the right side of an air drum 126 as viewed in FIG. 6, a second cam ring 256 having an inwardly extending flange 257 is carried on bearing housing flange 112 and is secured by bolts 258 which extend through adjusting bolts 259 and are threaded into flange 257. The adjusting bolts 259 are threaded through flange 116 of cover member 114 and contact the rear face of cam flange 257. Cam ring 256, similar to cam ring 156, has a cam groove 258 machined in its peripheral surface. Within the cam groove are a plurality of cam followers 260 which are identical to cam followers 166. These cam followers are secured to a plunger 262 with an L-shaped bracket and cam follower pin similar to the ones used with plungers 174. The plunger 262 extends through a heated plunger holding ring 264 which has a plurality of bores extending therethrough. The number of plungers 262 corresponds to the number of plungers 174 which, in turn, corresponds to the number of vacuum seats 206 on air drum 126. The bores in the heated plunger holding ring 264 are lined with a bronze brushing 266 which reduces friction and wear between the ring 264 and the plunger 262. The holding ring 264 is secured to main air drum 126 by a plurailty of bolts 268 which extend through an inwardly extending flange 270 of the holding ring and an insulating ring 272 and are threaded into air drum 126. Located within the heated plunger holding ring 264 is an annular heating element 274 which is connected to an electrical power source, as will be explained hereinafter. Since both the heated plunger holding rings 176 and 264 are secured to the main air drum 126, they will turn with drum 126 as the shaft 97 is rotated. The plungers 174 and 262 will move with the holding rings and, thus, cam follower assemblies 166 and 260 which are secured to the end of the plungers will move with the plungers. The cam rings 156 and 256 are stationary. The cam grooves 164 and 258 have a curved path which will cause the plungers 174 and 262 to reciprocate within the heated plunger holding rings 176 and 264. The plungers move inwardly towards the dual filter element 70 carried in the vacuum seat 206. FIGS. 9 and 10 illustrate the plungers in the extracted and the inserted positions.

Figure 12:
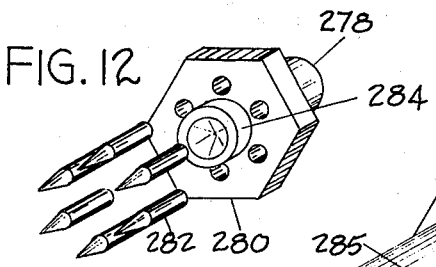
FIGS. 11, 12 and 12*a* are details of various probe configurations which can be secured to the plungers in accordance with the present invention.
Figure 12A:
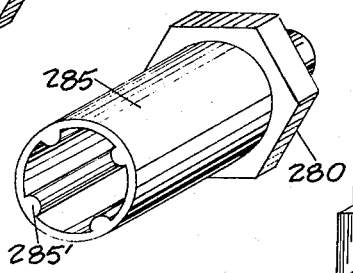
Figure 11:
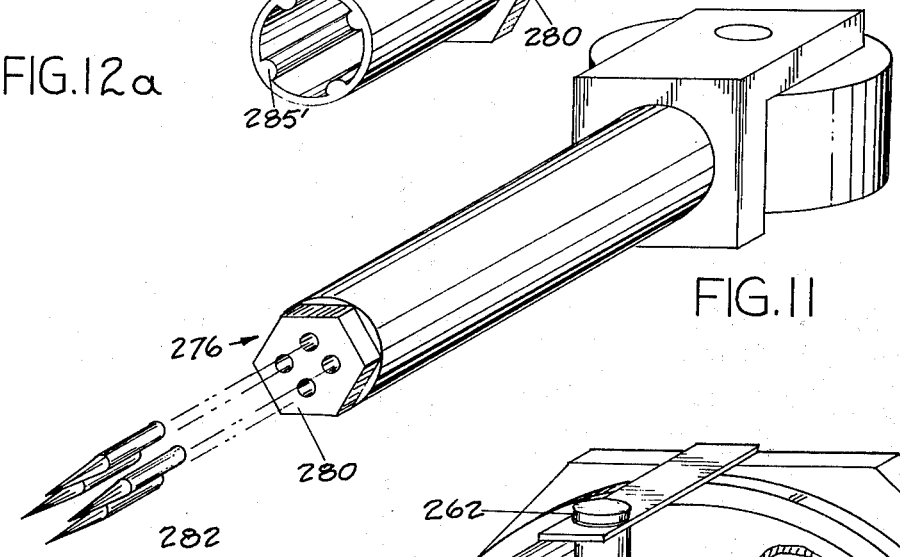

Each of the plungers have a probe assembly 276 secured to its end. FIG. 11 illustrates one configuration of the probe assembly which can be used. It should be understood that the probe assembly is not limited to this particular configuration. The probe assembly 276 has a hexagonal shaped plate 280 secured to a threaded portion 278 (FIG. 12) which extends into the threaded recess in the forward end of the plunger. The plate carries at least one probe, although a plurality of probes 282 are normally used. A modified configuration of the probe assembly is shown in FIG. 12. A cup-shaped member 284 is positioned within the periphery of the probe outline which will round off the center portion of the filter end and provide a depression in the filter body. Various other configurations can be used, (see FIG. 12A) for example, a sleeve 285 with internal linear ridges 285' can be so positioned on plate 280 that they will form linear grooves in the peripheral surface of the filter body.

Turning now to the electrical connection within the filter forming drum 34, the heating element 186 within holding ring 176 has terminals 288 having the leads of electrical wire 290 fastened thereto. The wire 290 passes through a bore 292 extending through flange 180 of holding ring 176, insulating ring 184, the air drum 126 insulating ring 272 and flange 270 of holding ring 264. The two leads from the wire are then secured to terminals 294 of heating element 274. A second wire 296 having its two leads secured to terminals 294 extends upwardly into an L-shaped bore 298 in shaft 97. The bore extends rearwardly through shaft 97 and exits through an opening at the end of the shaft. Each lead is secured to terminal 300 on the side of slip ring 302 carried contiguous to the end of shaft 97. The slip ring 302 is held in place by a nut 306 on the end of the shaft. Contact brushes 308 and 310 engage the peripheral surface of the slip ring 302 and are held in place by brush holders 312 and 314, respectively. The brush holders are secured in place by brackets 316 and 318. The brush holders have terminals 320 and 322 located thereon which are connected through wires 324 and 326 to a suitable power source. The slip ring 302 abuts a nut 303 threaded on shaft 97 which secures gear hub 304 in position. The hub abuts thrust washer 108 and holds it in position against bearing 102. The hub is keyed to shaft 97 by key 305 and carries a gear 96 which is used to drive the shaft 97. Gear 96 as shown in FIG. 6 meshes with idler gear 94 which extends through a slot 330 in cover 114.

The above described filter forming drum 34 operates in the following manner. The filters 70 (see FIG. 3) are passed from the transfer and acceleration drum 32 onto forming drum 34, the dual filters are deposited in the vacuum seats 206 which are carried on the periphery of air drum 126. As the filters are successively deposited in the vacuum seats 206, the bore 202 corresponding to the respective vacuum seat 206 passes into the circumferential groove 224 (see FIG. 8) in air ring 188 at end 332 of the groove. Since the vacuum is applied within the groove at all times, through a vacuum source which communicates with the groove through bores 236, tube 232 and bores 226 and 228, a vacuum is maintained on the vacuum seat 206 as the main drum rotates. The vacuum being maintained on the seat, the filters are held in place from the time the bore 202 associated with each seat passes end 332 of the groove 224 until the vacuum is broken by the bore passing over the opposite terminal end 334 of the groove 224.

During the movement of the main drum 126, the plungers carried in the plunger holding ring are reciprocated inwardly and outwardly by the various mechanism associated therewith, in particular cam rings 156 and 256 and cam followers 166 and 260. As soon as the dual filter 70 is deposited on the vacuum seat and the vacuum commences, the cam grooves 164 and 258 are designed to cause the plungers to begin their inwardly movement. The probes shown in FIG. 11 are inserted into the filter body. The heating elements 186 and 274 heat the holding rings 176 and 264 which, in turn, transfer the heat to the plungers 174 and 262. The plungers are made of a heat conductor material as are the probes, thus, the heat is transmitted to the probes. The probes are heated to a selected temperature, approximately 235° to 250° F. and will thereby form the cellulose acetate fibers in the filter body. If the probe shown in FIG. 11 were used, a plurality of passages or bores would be formed in each end of the filter body.

After the probes have been inserted into each end of the filter, the cam groove permits the probes to dwell within the filter for a pre-determined period of time prior to extraction. This dwell time insures proper forming of the cellulose acetate fiber. The probes are then extracted from each end of the filters. As the air drum continues to rotate, each of the bores 202 in air drum 126 passes terminal end 334 of grooves 224 in air ring 188 thus, breaking vacuum to seat 206. The bores 202 then pass over the bore 230 in the air ring which permits a supply of low pressure positive air to purge the vacuum seats. The filter is removed from the forming drum 34 and placed on transfer drum 36 prior to bore 202 passing over purge bore 230.

It has been found that, to manufacture filters on a commercial basis, the forming time required for properly setting the cellulose acetate is approximately one second with ¼ second to insert the probes into the filter ends and ¼ second to extract the probes. The forming time for the probes can be changed by changing the speed of the forming drum, changing the temperature of the probes or changing the cam groove path.

The temperature is maintained at a particular level by a temperature sensing device 340 (see FIG. 6) which extends through an aperture in cover member 150. The sensing device has a sensing element of a suitable material resting on the peripheral surface of heated plunger holding ring 176. The heat sensing device is held in place by a bracket arm 346 which is secured to back plate by bolt 348. The sensing device also prevents the cover 150 from rotating with the drum shaft. After the filter 70 is removed from the filter forming drum, it contains a plurality of bores or passages formed in each end of the filter.

As mentioned, the filters 70 are passed from the forming drum 34 to transfer drum 36 (see FIGS. 2 and 3) which, in turn, transfers the filter to a second transfer and acceleration drum 38 that deposits the filters on the cigarette drum 40 of the assembler.

Figure 13:
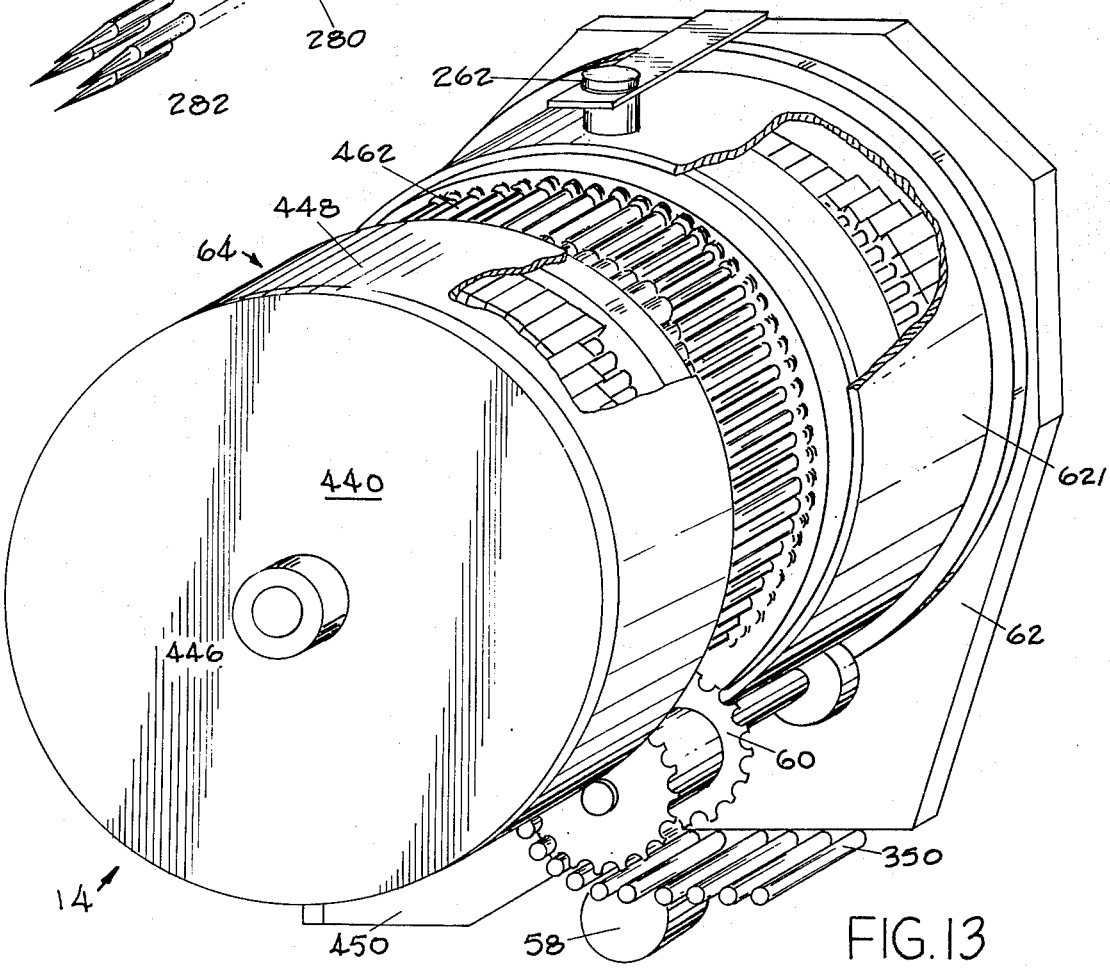
FIG. 13 is a perspective of the second forming drum having a portion of the covers broken away to expose the plunger mechanisms.

Tobacco rods are passed from a cigarette maker machine to the cigarette drum so that a tobacco rod is secured to each end of the cigarette filter, thus covering the end of the filter in which the passages or bores are formed. As the dual filter and tobacco rods are aligned on the cigarette drum, they form a double filter cigarette which is passed to a transfer drum 44. The transfer drum 44 passes a tipping drum 46, and a tipping wrapper is attached to the double cigarette unit. The wrapper is secured around the dual filter and tobacco rods on wrapping drum 48 and then the dual cigarette is passed through an inspection drum 50 for pressure drop testing. From the inspection drum, the double cigarette is passed onto a slitting drum 52 where the dual cigarette is slit in the center of the dual filter into two single cigarette units. The single cigarette units are passed onto a willie-turn drum where they are properly oriented. The cigarettes are deposited from the willie-turn drum on a catcher chain 56 which transports the cigarettes to the filter cigarette forming unit 14. From the catcher chain 56, single cigarette units 350 are picked up by a pick-up drum 58. (see FIGS. 13, 14 and 15). The cigarette units 350 are held on the pick-up drum by an entrance guide 352. As the cigarette units 350 travel on the pick-up drum 58, a semi-circular guide 354 engages the cigarette unit 350 and removes it from the pick-up drum 58 and places it on a transfer and acceleration drum 60. The cigarette unit travels around the transfer and acceleration drum 60 and is passed onto cigarette forming drum 64 where it is initially held in place by a guide 356.

The filter cigarettes pass around the periphery of the forming drum and a second forming operation is performed on the filter. On the exit side of the drum 64, a guide 358 holds the formed cigarette unit on forming drum 64 until it is engaged by an exit semi-circular guide 360 which removes the cigarette unit from drum 64 and places it on another transfer drum 66. From transfer drum 66, the cigarette units are deposited onto a conveyor belt 68.

Figure 16:
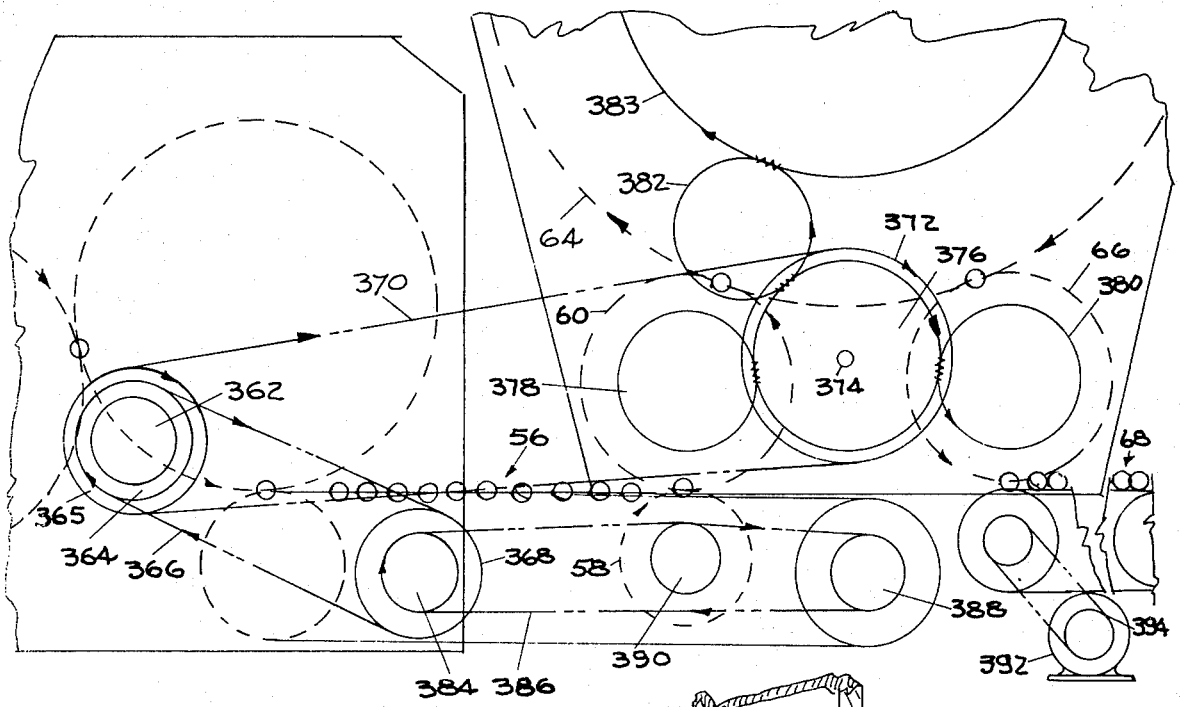
FIG. 16 is a rear diagramatic elevation view of the second forming drum illustrating a gear drive mechanism.

The cigarette forming unit 14 is driven from the power take-off for the catcher chain 56 (see FIG. 16) in the following manner. A gear 362 driven by the cigarette assembler drive system is mounted on a shaft suitably journaled to the assembler. The shaft also carries two sprockets 364 and 365. Sprocket 364 is surrounded by a chain 366 which drives the sprocket 368 for catcher chain 56. The second sprocket 365, through a chain 370, drives a sprocket 372 which is suitably journaled on the shaft 374 mounted on mounting plate 62. Also mounted on the shaft 374 is a gear 376 which meshes with and drives gears 378 and 380 for drum 60 and 66, respectively. An idler gear 382 mounted on a shaft suitably journaled to the mounting plate is driven by gear 376 and will drive gear 383 for the forming drum 64.

On the shaft of sprocket 368 is a second sprocket 384 having a chain 386 encircling it and engaging a shaft mounted sprocket 388 at the opposite end of the catcher. An additional sprocket 390 located between sprockets 384 and 388 is carried on the shaft of drum 58 and is contacted by chain 386 so that drum 58 can be rotated. As the formed cigarette units leave drum 66, they are deposited on conveyor 68 which is driven by a motor 392 having a sprocket and chain arrangement 394.

Figure 14:
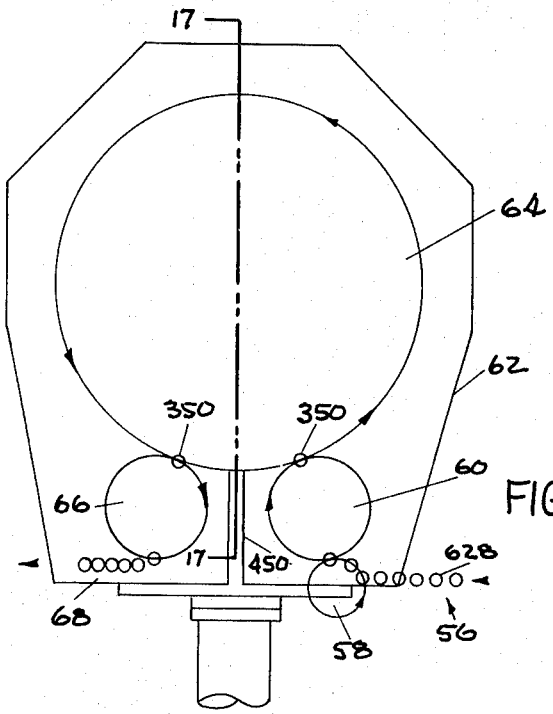
FIG. 14 is a diagramatic front elevation view of a second forming drum according to the present invention.
Figure 15:
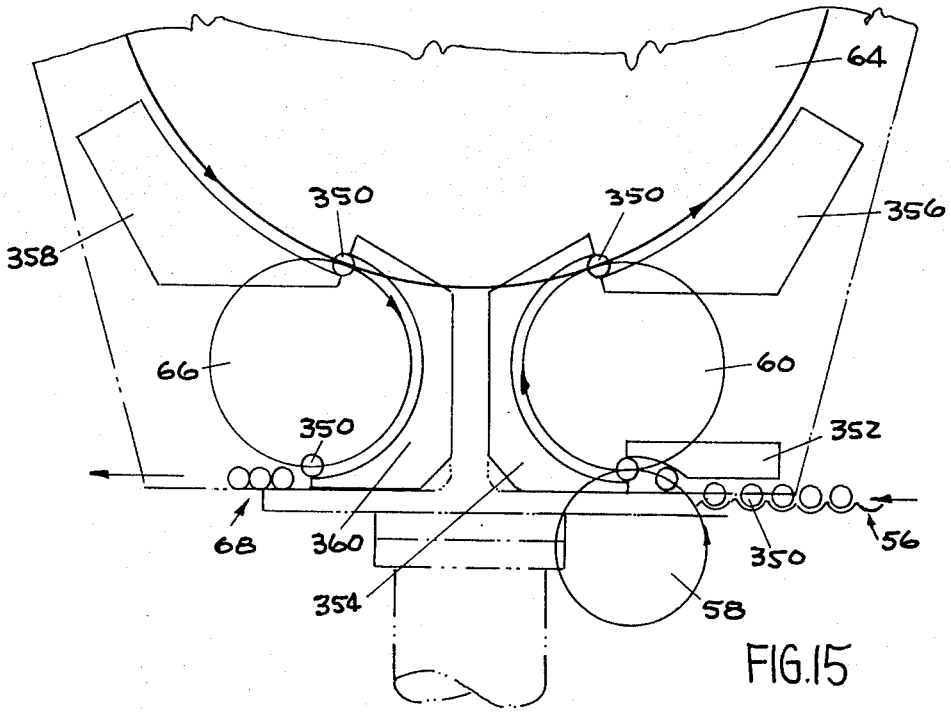
FIG. 15 is a partial diagramatic elevation view of the second forming drum and transfer and alignment drums showing the holding guides used to transfer the cigarette from the catcher conveyor onto the second forming drum.

Turning now to the cigarette forming drum 64, as can be seen in FIGS. 14 and 15, a cigarette unit 350 is transferred from transfer and acceleration drum 60 onto the cigarette forming drum 64.

Figure 18:
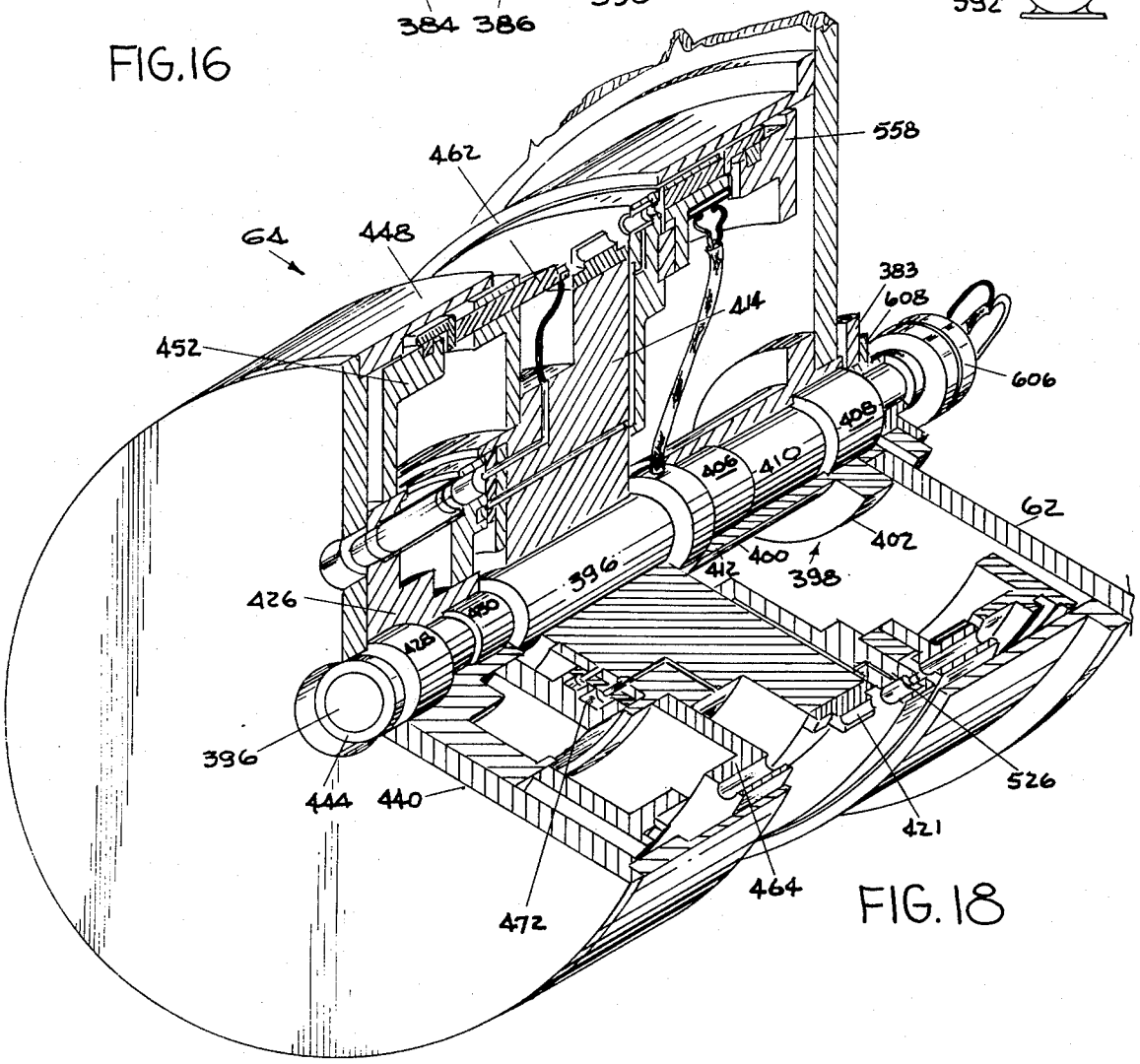
FIG. 18 is a cut-away perspective of the second forming drum according to the present invention.
Figure 17A:
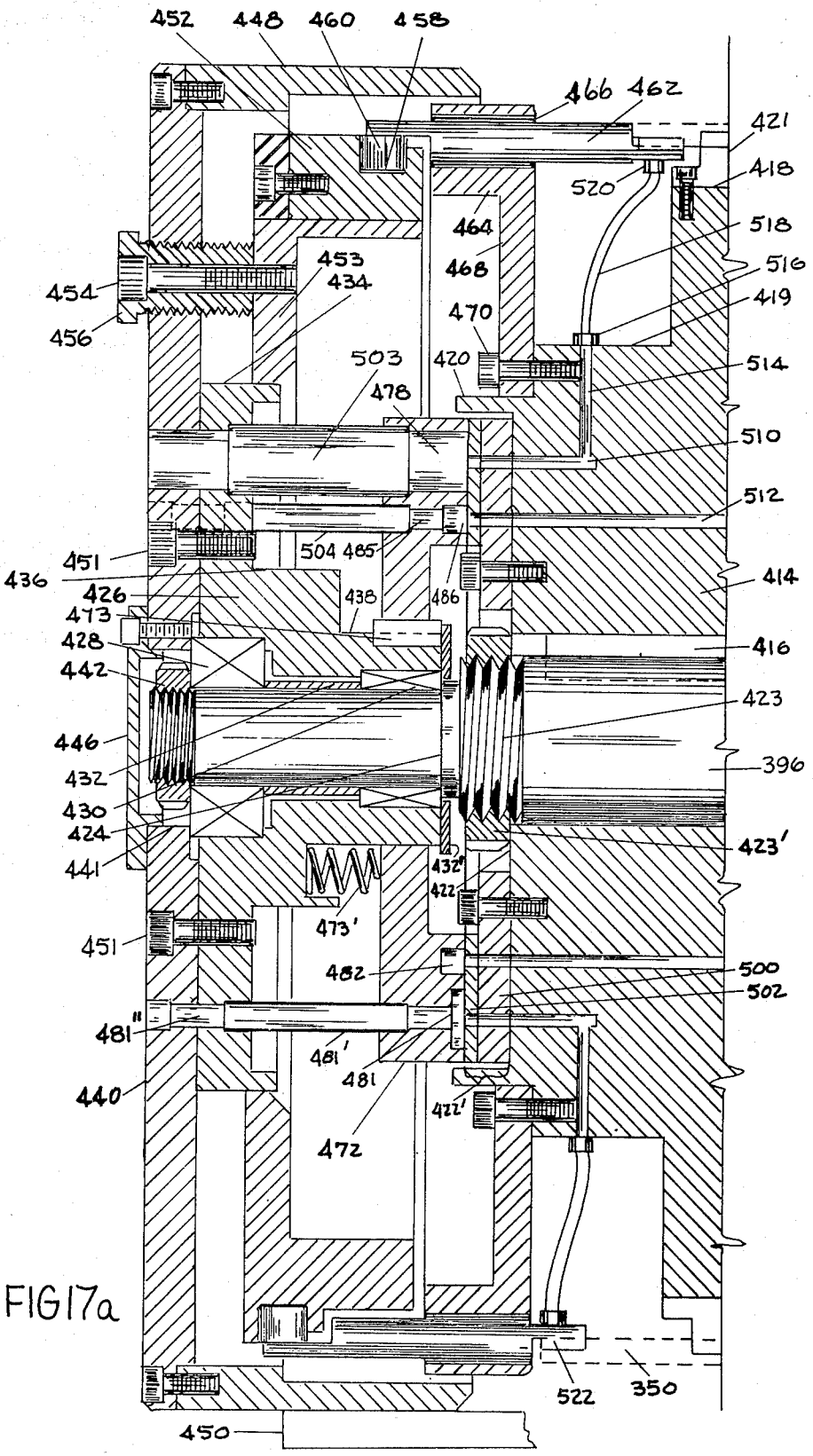
FIGS. 17A and 17B are portions of a cross-section view taken along line 17—17 of FIG. 14.
Figure 17B:
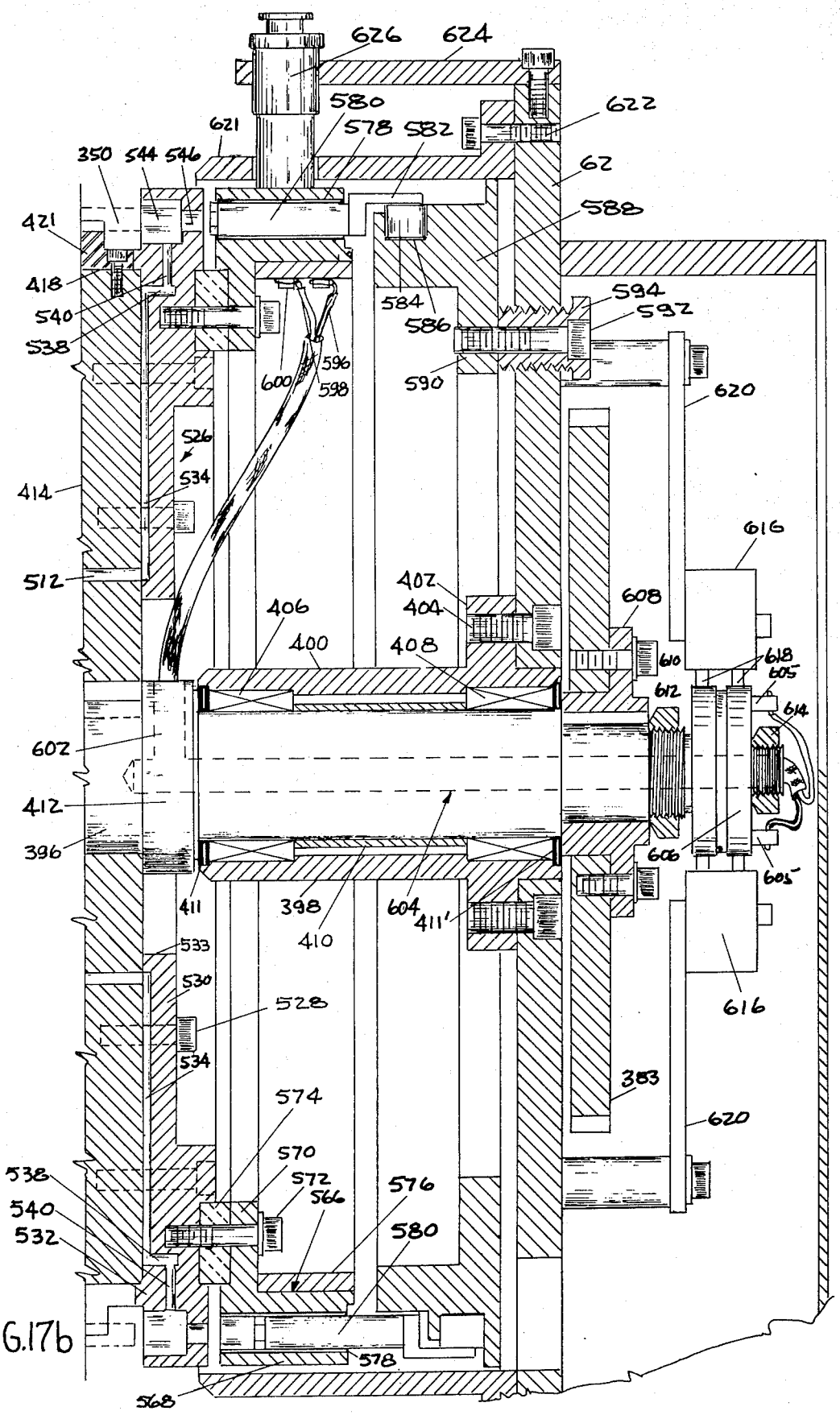

As can be seen in FIGS. 17A, 17B, and 18, the forming drum is mounted on mounting plate 62. A shaft 396 extends through a bore in rear bearing housing 398 which is secured to the mounting plate 62. The bearing housing has a tubular portion 400 with an annular flange 402 that abuts the forward face of plate 62 and is held in place by a plurality of bolts 404. Within the housing are forward and rear radial bearings 406 and 408, respectively, which are inserted within enlarged portions of the housing bore. A spacer 410 is provided between the radial bearings to aid in holding them in position. Thrust washers 411 and 411' hold the radial bearings 406 and 408 in position. Forward of the housing 398 and integrally formed with the shaft 396, there is an annular flange 412 which contacts thrust washer 411 and holds it in position.

An air drum 414 abuts the forward surface of annular flange 412 and is secured to shaft 396 by key 416. The drum 414 has a stepped cylindrical configuration with an outer, intermediate and inner steps 418, 419 and 420, respectively, and contains a plurality of air passages which will be described hereinafter. The drum carries a plurality of seats 421 on its outer peripheral surface 418. The seats receive the cigarette units from the transfer and acceleration drum 60 and maintain the cigarette unit in alignment as will be explained hereinafter. A circular recess 422 is provided in the forward face of the air drum and receives an air control plate 422' which will be described hereinafter.

The shaft 396 has a threaded portion 423 which receives a nut 423' which holds the air drum on the shaft. The shaft decreases in size forward of the air drum in a step relationship and forms a shoulder 424. Carried on the end of the shaft is a forward bearing housing 426 which is suitably journaled on the shaft by radial bearings 428 and 430. Again an enlarged portion in the housing bore is provided to receive the radial bearings and a spacer 432 is provided to aid in positioning the bearings. A retaining washer 432' is suitably secured to the small end of the housing 426 to aid in holding rear bearing 430 in position. The housing is stepped similar to the air drum having an outside step 434, a middle step 436 and an inside step 438.

The rear radial bearing 430 abuts shoulder 424 while the forward bearing 428 and the outer face of the housing 426 abuts a circular cover plate 440. The circular cover plate has a center aperture 441 large enough to accommodate a nut 442 which is threaded on the end of the shaft 396. The aperture is covered with a plate 446. Extending inwardly from and secured to the outer edge of circular plate 440 is a tubular cover portion 448. The cover member 440 and 448 are stationary and will not rotate when the shaft is rotated. A brace 450 extending beneath the drum and attached to back plate 62 between transfer drum 60 and 66 (see FIG. 14) secures the cover members 440 and 448 in position.

The forward bearing housing 426 is suitably secured to the cover 440 by bolts 451 and is, therefore, held stationary. A cam ring 452, having an inwardly extending annular flange 453 which rests on the outer step 434 of the bearing housing, is held in a non-rotating position by bolts 454 which extend through adjusting bolts 456. Adjusting bolts 456 are threaded through the cover 440 and contact the outer surface of flange 453. These adjusting bolts are used to adjust cam ring 452 linearly with respect to the air drum.

A cam groove 458 is provided in the outer peripheral surface of the cam ring 452 similar to the cam grooves of the small forming drum 34, described above. A plurality of cylindrical cam followers or rollers 460, equal in number to the seats 421 on air drum 414, are positioned in the cam groove. Each cam follower has attached thereto a reciprocating vacuum seat plunger 462 which extends inwardly through a bore in a non-heated plunger ring 464. The bore in the plunger ring has a bronze bushing 466 to prevent the plunger from binding and to permit easy reciprocation of the plunger. Extending inwardly toward the shaft and formed integrally with the plunger ring 464 is an annular flange 468 which rests on inner step 420 of the main drum 414. The flange is secured to the durm 414 by a plurality of bolts 470 so that the plunger ring 464 rotates with the drum 414 as shaft 396 is rotated.

A hardened steel air control ring 472 is carried on the inside step 438 of bearing housing 426 and is keyed thereto by key 473. The air control ring is prevented from sliding off the housing step by washer 432'. A spring 473' maintains air control ring 472 against air control plate 422'. The air ring 472 controls the vacuum and air flow through the passages 510 and 512 in the air drum 414.

Figure 19:
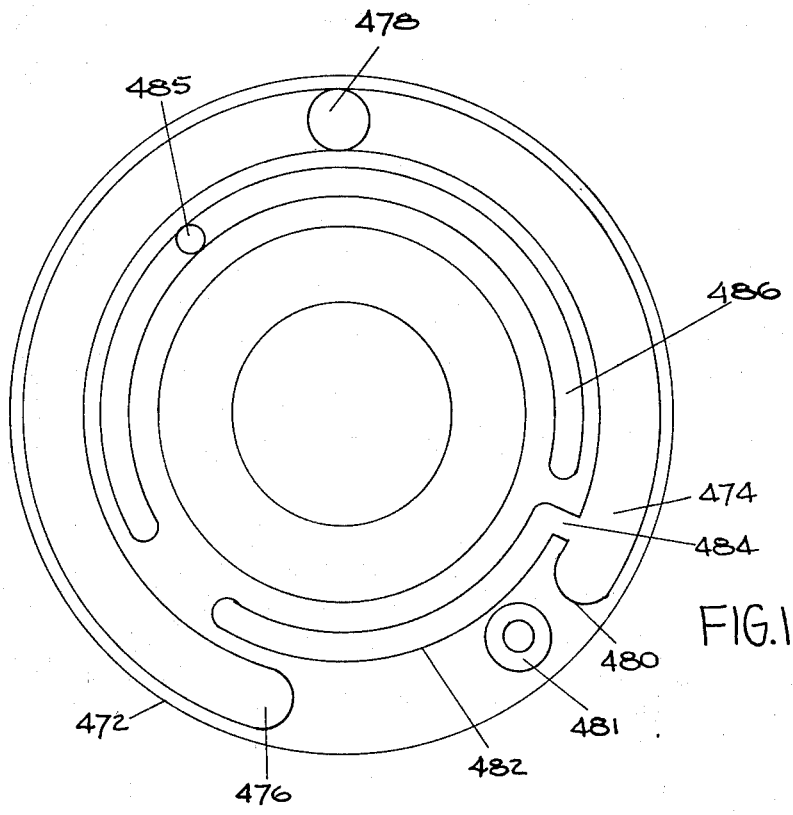
FIG. 19 is a front view of an air control ring associated with the second forming drum is accordance with the present invention.

Illustrated in detail in FIG. 19, the air control ring 472 is viewed from inside the drum looking outwardly, therefore, the position of the entrance and exit points of the grooves on the ring will be reversed when the ring is positioned in the drum. The air ring has a large outer groove 474 spaced from its center and contiguous to its outer edge. The groove does not extend a complete 360° about the face of the ring. The ring 472 is positioned on the housing 426 so that the pick-up end 476 of the groove 474 will be positioned at approximately the leading end of guide 356 (see FIG. 15). A bore 478 extends through the ring and communicates with the groove 474. Contiguous to the terminal end 480 of the groove 474 is a purge port 481 which communicates with a low pressure air source through tube 481' and passageway 481'' through housing 426 and plate 440. This purge port purges the vacuum line to the plunger vacuum seat as will be explained hereinafter.

Located inwardly from the vacuum groove 474 are two grooves spaced around the ring which are on the same radial center line. Groove 482 begins prior to the terminal point 480 of groove 474 and extends clockwise as shown in FIG. 19, terminating shortly after the pick-up point 476 of groove 474. There is a radially extending passage 484 between the grooves 474 and 482 at the beginning of groove 482. Preceding clockwise, as shown in FIG. 19, a positive air groove 486 begins and extends clockwise around the ring terminating prior to the beginning of groove 482. A bore or passage 485 extends through the ring and terminates in the groove 486.

As mentioned above, the air ring 472 is keyed to the bearing housing 426 and, therefore, does not rotate. The air ring is positioned so that the grooves face inwardly and contact air control plate 422' which is in recess 422 on air drum 414. The air control plate includes an annular securing steel plate 500 and a carbon wear ring 502 secured to the plate by an adhesive or other suitable means.

The vacuum bore 478 in air control ring 472 receives a tube 503 which extends into the outside step of housing 426. The bore in the housing 426 extends through the cover 440 and communicates with a vacuum source (not shown). Bore 485 in positive air groove 486 has a tube 504 which extends into another bore in the housing 426 which also extends through the cover 440 and communicates with a positive air source.

As mentioned above, the air control ring 472 contacts the air control plate 422' which includes wear ring 502 and annular plate 500. The wear ring and plate have a plurality of passages extending therethrough which communicate with passages 510 and 512 in the main air drum 414. These air passages 512 are parallel to the center line of the shaft 396 and extend through the drum terminating at points on the opposite side of the air drum. The bores 510 extend into the drum a short distance and are parallel to the axis of shaft 396. Bores 510 terminate at radially extending bores 514 which extend outwardly from bore 510 through the intermediate step 419 on the air drum 414. The bores 514 receive a flexible tube fitting 516 which, in turn, receives a flexible tube 518 that communicates with a second fitting 520 secured to the end of vacuum plungers 462.

Figure 20:
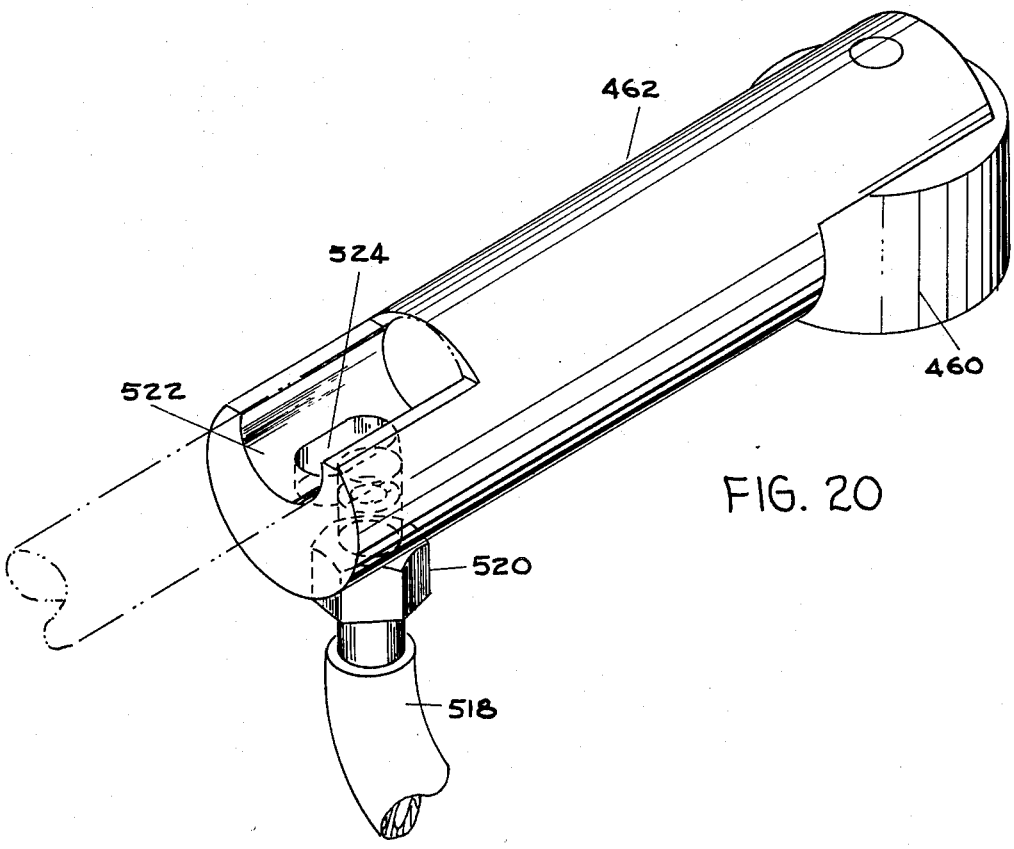
FIG. 20 is a detail perspective of a vacuum seat plunger according to the present invention.

A detail of the vacuum seat plunger 462 is shown in FIG. 20. As can be seen, the forward end of the vacuum seat plunger has a semi-circular groove 522 within the upper portion of the cylinder of the plunger. An elongated aperture 524 is in the bottom of the plunger groove and communicates with the bore into which fitting 520 is threaded.

Figure 21:
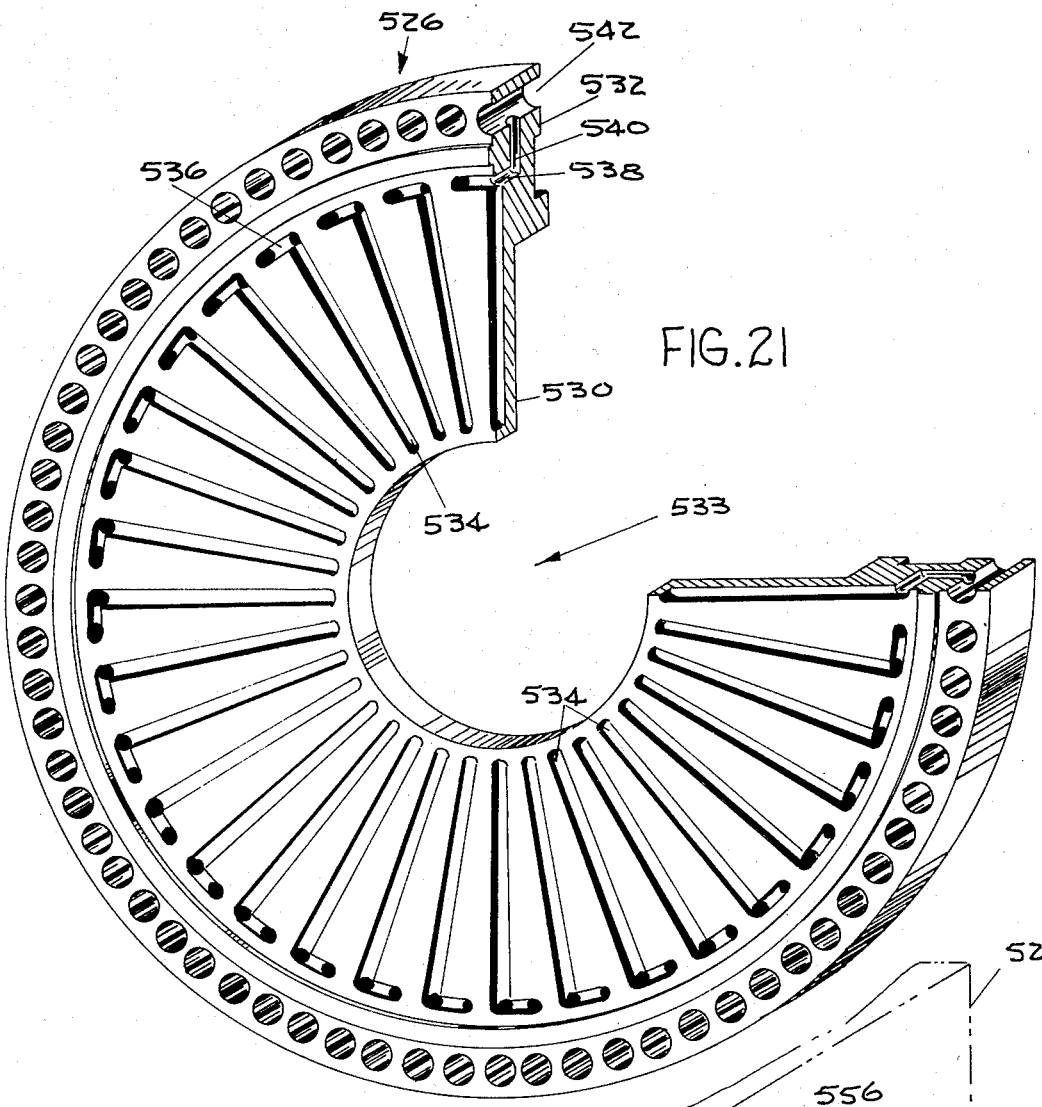
FIG. 21 is a cut-away perspective of a gland ring associated with the second forming drum in accordance with the present invention.

As mentioned before, bores 512 extend through the drum 414 and terminate in points on the opposite side of the drum. These points communicate with gland ring 526 secured to the rear face of the drum by a plurality of bolts 528. A detail of the gland ring is shown in FIG. 21. The gland ring 526 has an air control feature and is generally circular in shape having a plate flange portion 530 and an enlarged circumferential portion 532 with center aperture 533 through the plate flange portion 530. Formed in the surface of the gland ring contacting drum 414 are a plurality of radially extending grooves 534. The number of grooves corresponds to the number of bores 512 which extend through the drum 414; however, this number is only half the number of seats 421 which are secured to the peripheral edge 418 of the drum. Each of the radially extending grooves has a short groove 536 that extends counterclockwise or to the left of the groove. At the intersection of radially extending groove 534 and the short groove 536 are inwardly extending bores 538 which extend into the enlarged portion 532 of the drum. At the termination of inwardly extending bores 538 are radially extending internal bores 540 which extend outwardly and communicate with a gland bore 542 that extends through the gland holding ring 526.

Figure 22:
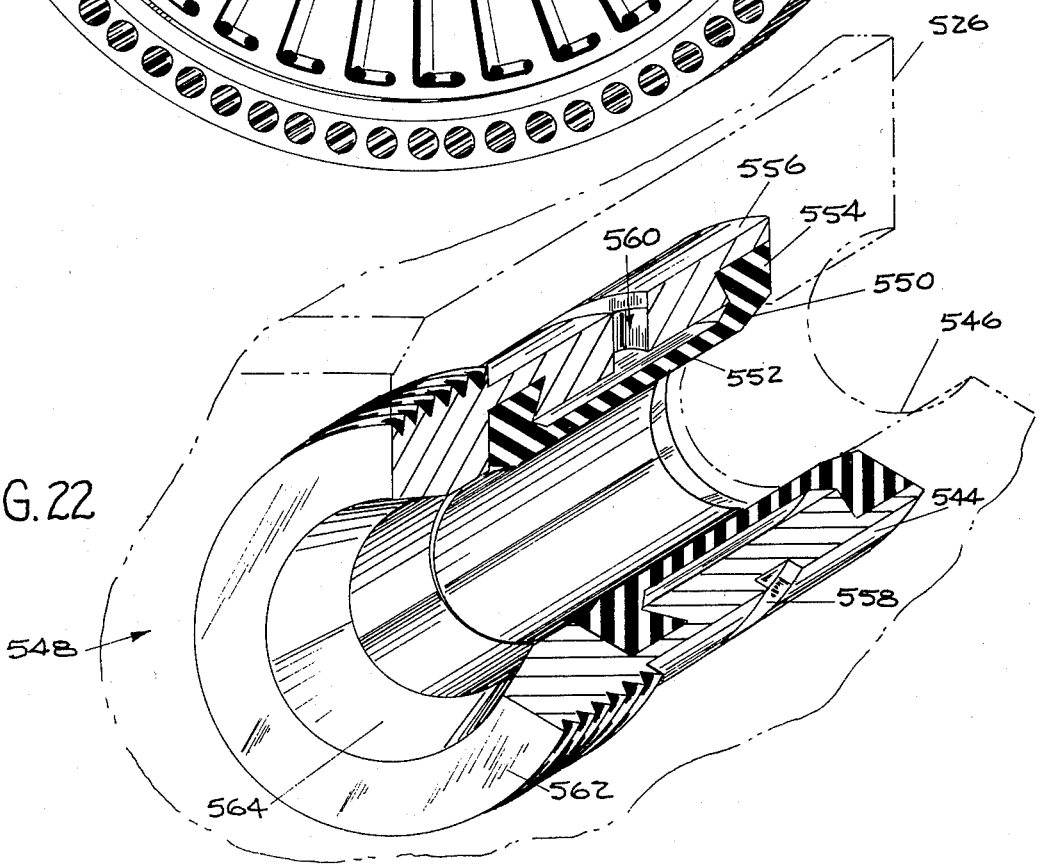
FIG. 22 is a detailed perspective of a gland assembly used in the gland ring according to the present invention.

When the gland ring is secured to the drum 414, the gland bore 542 is parallel to the axis of shaft 396. The gland bore 542 has an enlarged portion 544 (see FIG. 22) which communicates with bore 540 and a smaller portion 546 which extends rearwardly through the ring. Carried within the enlarged portion 544 is a gland assembly 548. The gland assembly has a tubular flexible gland 550 consisting of a tubular portion 552 and enlarged end portions 554 which permit the gland to be secured by a spacer cylinder 556. The spacer cylinder has an external peripheral groove 558 and has a plurality of holes 560 which extend from the groove in the outside surface of the spacer and communicate with the space between the tubular portion 552 of the gland and the bore of spacer 556. A circular plug 562 is threaded into the bore 544 in the gland ring and holds the gland assembly in a fixed position. The plug has a frusto-conically aperture 564 through its center to permit a cigarette unit be be inserted in the gland.

Spaced rearwardly from the gland ring 526 is a plunger holding ring 566 which has an enlarged outer portion 568 with a plunger bore extending therethrough and an inwardly extending flange 570 (see FIG. 17B). A plurality of boits 572 secure the plunger ring to the gland ring and an annular insulating spacer 574 is provided between the gland ring and the plunger ring. A circular heater 576 is provided within the plunger ring so that the plunger ring can be heated. Within the plunger bore of the plunger ring is a cylindrical bronze bushing 578. A plunger 580 extends through the bore and the plunger has a bracket 582 secured to its rearward end which is secured to a cam follower 584. The cam follower is carried within a cam groove 586 which is machined in the outer peripheral surface of a cam ring 588. The cam ring 588 has an inwardly extending flange 590 which has a plurality of bolts 592 threaded therein to secure the cam ring to the mounting plate 62. The securing bolt 592 extends through adjusting bolts 594 which control the rear face of flange 590 and permit the axial adjustment of the cam ring.

Turning now to the heater element 576, two wires 596 and 598 are secured to terminals 600 on the heater and pass through a bore 602 in the enlarged portion 412 of shaft 396. The bore 602 extends to the center line of the shaft and communicates with an axially extending bore 604 which extends rearwardly through the end of the shaft. The wires are secured to terminals 605 on a slip ring 606 positioned on the end of the shaft. Positioned inwardly of the slip ring 606 is a gear 383 used to rotate the shaft. The gear is secured to a hub 608 which is, in turn, keyed to shaft 396 by key 610. The hub and gear are held on the shaft by a nut 612 which is threaded onto a threaded portion of the shaft. The shaft decreases in size rearwardly of nut 612 to form a shoulder that slip ring 606 abuts. The slip ring 606 is held in place by a nut 614 which is threaded onto the end of the shaft 396. A pair of brush holders 616 are positioned about the slip ring and have brushes 618 extending to contact the slip ring surface. The holders are connected to a suitable power source (not shown) and are held in position by a bracket 620 which is secured to mounting plate 62.

Secured to the mounting plate and extending around the periphery of the plunger ring 566 and the cam ring 588 is a tubular cover 621 which is secured to the mounting plate 62 by bolts 622. A bracket 624 carrying a temperature sensing mechanism 626 is secured to the top of mounting plate 62. The sensing unit 626 extends through an aperture in the cover 621 and has a heat sensing element which rests on the outer peripheral surface of the plunger ring 566.

The cigarette forming drum operates in the following manner. A cigarette unit 350 leaves the catcher chain 56 and is deposited on transfer and acceleration drum 60 (see FIGS. 14 and 15). The cigarette unit 350 is then deposited on the forming drum 64 and positioned with the tobacco rod end in the vacuum seat on the vacuum plunger 462 and the filter end being placed in the seat 421 on drum 414.

Figures 23, 24, 25:
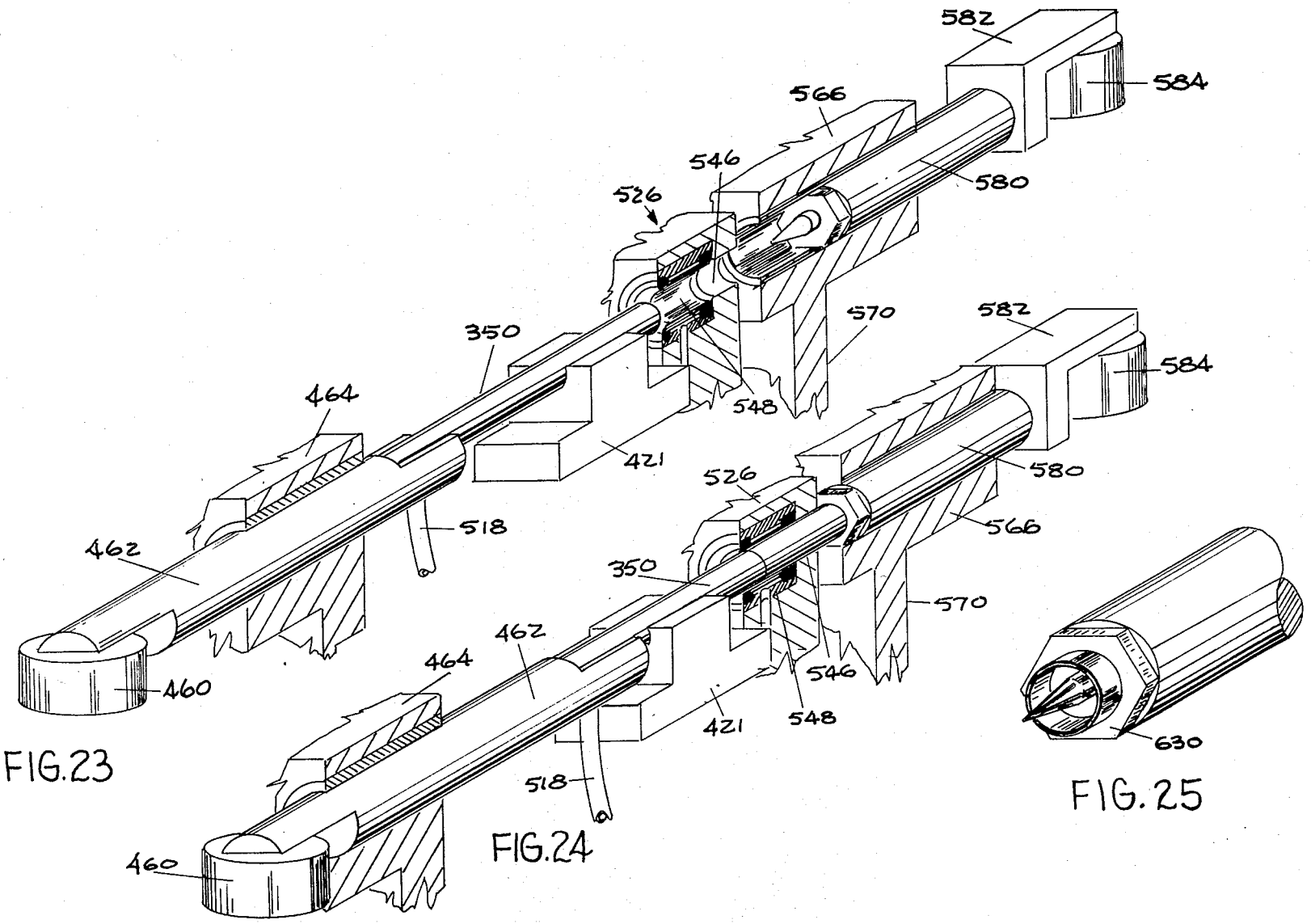
FIGS. 23 and 24 are detail perspectives of the plunger mechanism used in the second forming drum in their retracting and inserting positions, respectively.
FIG. 25 is an enlarged detail of an embodiment of the probe used with the second forming drum according to the present invention.

As can be seen in the lower position in FIGS. 17A and 17B, the cigarette unit has a space between the end of the tobacco rod and the end of the plunger vacuum seat 522. As the air drum 414 rotates counterclockwise, the plunger begins to reciprocate inwardly until the end of the plunger abuts the tobacco rod end of the cigarette unit. At this point, the vacuum is applied through air control ring 472, bores 510 and 514 and tube 518 to the vacuum seat in the end of the plunger. The cigarette unit is held firmly in plunger 462 as the air drum continues to rotate. The cam rings 452 and 588 are held stationary and, therefore, do not rotate with the drum. However, the plunger holding rings 464 and 566 as well as the gland ring 526 are secured to the air drum 414 and, thus, will rotate with the drum. The cam groove 458 causes the vacuum seat plunger 462 to reciprocate inwardly, forcing the filter end of the cigarette through the frusto-conical aperture 564 in plug 562 and through the gland assembly 550 carried in gland ring 526. After the filter end of the cigarette has been inserted into the gland ring, (detailed description hereinafter) the low pressure air is applied through the groove 486 in air ring 472. The air is directed through bore 512 into the appropriate radial grooves 534 through bores 538 and 540 to the groove 558 associated with the spacer 556 of the gland assembly. The positive air is then directed through holes 560, causing the gland to expand and clamp the cigarette and hold it in position. As the drum continues to rotate, heated plunger 580 is reciprocating inwardly so that a probe secured to its end is inserted onto the end of the filter unit. For a detailed illustration of this operation, see FIGS. 23 and 24. Any suitable probe may be attached to the end of the heated plunger and one such probe 630 is illustrated in FIG. 25. It should be understood that any suitable configuration of probe can be used. The plunger 580 is heated by circular heater 576 which is connected to a power source through conductors 596 and 598 and slip ring 606. Preferably the temperature of the probe should be between 250° and 325° F. The time for the process of insertion, forming and extraction is approximately 1½ seconds, with a dwell or forming time of 1 second. This means that, one quarter of a second is used to insert the probe into the filter end and one quarter of a second to extract the probe. The temperature of the system is, of course, sensed by the temperature sensing device 626 and maintained at the proper level. It has been found that the temperature can be lowered by applying a moistening agent, such as water, to the end of the filter. This may be applied by spraying the filter end of the cigarette just prior to the cigarette unit leaving the catcher chain 56. As can be seen in FIGS. 1 and 14, a nozzle 628 may be provided to spray the end of the cigarette filter. It has been found that a suitable probe temperature maintained when using moisture in forming the cigarette filters is approximately 250°.

Turning now to a more detailed description of the operation of the air ring 472, it can be seen that, as the cigarette unit is being transferred from the transfer drum 60 onto the forming drum 64, the trannsfer occurs at approximately the 5 o'clock position indicated in FIG. 14. As the cigarette is placed in the vacuum seat of plunger 462, a vacuum is applied at pick-up point 476 (see FIG. 19) through groove 474 and appropriate bores in the air drum 414 to the vacuum seat. The vacuum is maintained on the vacuum seat until terminal point 480 of groove 474 passes the various ports of bores 510 at which time the vacuum is cut off. Thereafter, the various ports of bores 510 pass purge port 481. Purge port 481 is connected to a low pressure air which permits the line to be purged in case any foreign object such as tobacco gets into the vacuum line. With regards to the inner grooves which control the gland assembly, it will be noted that the groove 482 is connected through passage 484 to the vacuum source. Therefore, just prior to the cigarette unit being released from the vacuum seat at terminal point 480, a vacuum is applied to the gland assembly when the port in air control plate 422' associated with bore 512 passes into the groove 482, thereby opening the gland and permitting the cigarette unit to be withdrawn from the gland ring by the vacuum seat plunger. The gland remains open until another cigarette unit is placed in the vacuum seat and the vacuum seat plunger has been reciprocated inserting the filter end of a cigarette unit into the gland assembly. At this point, the port 512 passes onto the positive air groove 486 where positive air is directed into the gland to clamp the filter in position.

After the filter has been clamped into position (see FIGS. 22 and 24), the heated plunger 580 is reciprocated and the probe is inserted through bore 546 into the filter. As the cigarette units continue to rotate with the drum, the probe plunger 580 is withdrawn from the filter. When the cigarette unit has been removed from the gland, the formed cigarette is transferred from the forming drum 64 and deposited on transfer drum 66 by guide 360. From the transfer drum 66, the cigarette units 350 are deposited on conveyor 68.

It can be seen from the above description the drawings that the apparatus and method described hereinabove provides for forming cigarette filters and joining the filters with tobacco rods. It also provides an apparatus and method for high speed forming of cellulose acetate cigarette filters by the use of heated probes or dies. Both internal bores and external grooves can be formed in the filter plugs of a cigarette unit by the use of this method and apparatus. The apparatus also provides a mechanism for manipulating a plurality of heated probes which can be inserted into the ends of the filter plugs to form the bores.

As will be apparent to those skilled in the art, there are many variations and changes that can be made to the apparatus as defined hereinabove without departing from the invention described hereinabove. For example, the configurations of drums and rings may be changed, variations in the materials used in manufacturing these particular parts can be made, etc.; however, variations and changes of this nature can be made to the above described and illustrated invention without departing from the true spirit and scope thereof as defined in the following claims.

What is claimed is:

1. An apparatus for forming filters of a filter cigarette comprising:

a. a first set of seat means for receiving one filter cigarette;

b. conveyor means for carrying said first set of seat means and moving said first set of seat means in a selected path;

c. second set of seat means located on one side of said first set of seat means, the seats of said second seat means corresponding to the seats in said first seat means, said second seat means receiving the tobacco rod end of the filter cigarette;

d. means for maintaining a negative pressure in said second seat means;

e. means for manipulating said second set of seat means;

f. gripper means including a tubular gland member which receives the filter end of the cigarette, said gland means being inflated to grasp the filter cigarette as it is being formed;

g. means for providing pressure to said gland, a positive pressure to inflate said gland after said filter cigarette is inserted therein and at least an atmospheric pressure to deflate said gland after forming the filter but before said cigarette is removed from the gland;

h. forming means associated with said seat means for forming the filter into a desired configuration;

i. means for manipulating said forming means so that it will sequentially engage and disengage from said filters; and j. means for maintaining said forming means at a selected temperature.

2. An apparatus for forming both the interior and exterior ends of a filter of a filter cigarette comprising:

a. first means for receiving and holding a plurality of filters;

b. first forming means associated with said first receiving and holding means for forming said interior end of said filter into a desired configuration;

c. first means for manipulating said first forming means so that said first forming means engages said filters;

d. first means for maintaining said forming means at a selected temperature;

e. means for securing the filters to a tobacco rod with the interior formed end of the filter abutting the tobacco rod to form a filter cigarette;

f. rotatable drum means for receiving said filter cigarette;

g. second seat means mounted on the periphery of said drum, each seat in said first seat means receiving one filter cigarette;

h. third seat means located on one side of said second seat means, the seats in the third seat means being aligned with corresponding seats of the first set and receiving the tobacco rod end of one filter cigarette;

i. means for maintaining a negative pressure in the seat of said third seat means to hold the filter cigarettes in position;

j. means for manipulating said third seat means;

k. gripper means located on the opposite side of said second seat means from said third seat means, said gripper means grasping the filter end of said filter cigarette when the filter end of the cigarette is inserted into said gripper means as the seats in the third seat means are manipulated;

l. means for operating the gripper means;

m. second forming means associated with said drum means for forming the exterior end of the filter into a desired configuration;

n. a second means for manipulating said second forming means so that said second forming means engages the exterior end of the filter cigarette; and o. means for maintaining the second forming means at a selected temperature.

3. The apparatus of claim 2, wherein said third seat means include:

a. a second set of plungers, each of said plungers having a seat groove in one end for receiving the tobacco rod end of a filter cigarette; and b. second plunger holding means for maintaining the plunger seats in alignment with the corresponding seat in said second set of seats and said gripper means.

4. The apparatus of claim 3, wherein said means for manipulating said third seat means includes:

a. second set of cam followers, each cam follower in said second set being secured to the corresponding plunger in said second set of plungers; and b. a second cam means associated with said second seat of cam followers, said second cam means and said second set of cam followers causing said second set of plungers to reciprocate so that said filter end of the cigarette is inserted into and retracted from said gripper means.

* * * * *